United States Patent [19]

Nakaniwa

[11] Patent Number: 5,065,728

[45] Date of Patent: Nov. 19, 1991

[54] SYSTEM AND METHOD FOR CONTROLLING AIR/FUEL MIXTURE RATIO OF AIR AND FUEL MIXTURE SUPPLIED TO INTERNAL COMBUSTION ENGINE USING OXYGEN SENSOR

[75] Inventor: Shinpei Nakaniwa, Gunma, Japan

[73] Assignee: Japan Electronic Control Systems Co., Ltd., Isezaki, Japan

[21] Appl. No.: 541,803

[22] Filed: Jun. 21, 1990

[30] Foreign Application Priority Data

Jun. 21, 1989 [JP] Japan ..... 1-156748

[51] Int. Cl.[5] ..... F02M 51/00

[52] U.S. Cl. ..... 123/489; 123/440

[58] Field of Search ..... 123/489, 440, 198 DB, 123/198 D, 480, 479; 364/431.07, 431.05, 431.16

[56] References Cited

U.S. PATENT DOCUMENTS

| | | | |
|---|---|---|---|
| 4,870,938 | 10/1989 | Nakaniwa | 123/489 |
| 4,911,129 | 3/1990 | Tomisawa | 123/489 |
| 4,913,118 | 4/1990 | Watanabe | 123/435 |
| 4,933,863 | 6/1990 | Okano et al. | 364/431.07 |
| 4,938,194 | 7/1990 | Kato et al. | 123/479 |
| 4,947,818 | 8/1990 | Kamohara et al. | 123/479 |

FOREIGN PATENT DOCUMENTS

| | | | |
|---|---|---|---|
| 60-240840 | 11/1985 | Japan | 123/489 |
| 63-51273 | 4/1988 | Japan | 123/489 |
| 64-458 | 1/1989 | Japan | 123/489 |

*Primary Examiner*—Raymond A. Nelli

*Attorney, Agent, or Firm*—Foley & Lardner

[57] ABSTRACT

A system and method for controlling an air/fuel mixture ratio of an air mixture fuel sucked into an internal combustion engine are disclosed in which an operating variable (PL, PR) of an air/fuel mixture ratio feedback correction coefficient (LAMBDA) is controlled so as to compensate for the deviation of the air/fuel mixture ratio (an average air/fuel mixture ratio) from a target air/fuel mixture ratio (stoichiometric air/fuel mixture ratio) according to an output characteristic variation of an oxygen sensor installed in an exhaust passage, the oxygen sensor outputting a voltage according to the air/fuel mixture ratio. A degree of deterioration of the oxygen sensor, i.e., the output characteristic variation of the oxygen sensor is determined according to a response balance between a rich side response and lean side response of the oxygen sensor, the response balance being determined on the basis of at least one of a plurality of parameters, a first parameter being a speed of change in the output voltage of the oxygen sensor, a second parameter being a duration of time during which the air/fuel mixture ratio is started to change toward the target air/fuel mixture ratio, and a third parameter bein the rich and lean control durations of time during which the system controls the air/fuel mixture ratio toward the target air/fuel mixture ratio with the feedback correction coefficient (LAMBDA).

28 Claims, 13 Drawing Sheets

SYSTEM AND METHOD FOR CONTROLLING AIR/FUEL MIXTURE RATIO OF AIR AND FUEL MIXTURE SUPPLIED TO INTERNAL COMBUSTION ENGINE USING OXYGEN SENSOR

BACKGROUND OF THE INVENTION (1) Field of the Invention

The present invention relates to a system and method for controlling an air/fuel mixture ratio of an air/fuel mixture supplied to an internal combustion engine in which an operating variable of a feedback correction coefficient (LAMBDA) is corrected in accordance with a degree of deterioration of an oxygen sensor so that the air/fuel mixture ratio of the air/fuel mixture sucked into the engine reaches a target air/fuel mixture ratio.

(2) Background of the Art

A Japanese Patent Application First Publication (Non-examined) Showa 60-240840 published on Dec. 29, 1985 exemplifies one of previously proposed air/fuel mixture ratio controlling systems.

In the above-identified Japanese Patent Application First Publication No. Showa 60-240840, an intake air quantity Q and/or intake air pressure PB is detected as an input variable related to intake air. A basic fuel supply quantity $T_p$ is calculated on the basis of the input variable such as Q and/or PB and another input variable such as an engine revolutional speed N.

The basic fuel supply quantity $T_p$ is corrected with various kinds of correction coefficients COEF set on the basis of each of various engine driving conditions such as engine temperature represented by an engine coolant temperature, air-fuel mixture ratio correction coefficient LAMBDA (λ), and a correction coefficient $T_s$ relative to a variation of a battery voltage to calculate a final fuel supply quantity $T_i=(T_p \times COEF \times LAMBDA + Ts)$. The calculated quantity of fuel is supplied to the engine through a fuel injector(s).

The air/fuel mixture ratio feedback correction coefficient LAMDA is set, e.g., in a proportional-integral control (P-I) mode. When the actual air/fuel mixture ratio based on the oxygen concentration in the exhaust gas second by means of the oxygen sensor is rich (or lean) with respect to a stoichiometric air/fuel mixture ratio (target air/fuel mixture ratio), the correction coefficient LAMBDA is initially decreased (or increased) by a proportional constant P and thereafter is gradually decreased (or increased) by an integration constant I in synchronization with time or engine revolutions so that the actual air/mixture ratio is repeatedly reversed in the vicinity of the target air/fuel mixture ratio. When repeating the rich and lean air/fuel mixture ratios for the same time, an average air/fuel mixture ratio is, thus, controlled to the target air/fuel mixture ratio.

For the oxygen sensor used in feedback control of the air/fuel mixture ratio, a sensor utilizing oxygen concentration in the exhaust gas rapidly changed with the stoichiometric air/fuel mixture ratio as a boundary and capable of detecting richness and leaness of the actual air/fuel mixture with respect to the stoichiometric air/fuel mixture ratio has commonly been used. The sensor is so constructed that an electrode is formed on each of inner and outer surfaces of a zirconia tube and an electromotive force is generated between both eletrodes according to a ratio between the oxygen concentration in the air introduced into the inner side of the tube and that in the exhaust gas emitted on the outer side of the tube. If the electromotive force is monitored, the oxygen concentration in the exhaust gas, i.e., the rich and lean in the intake air mixed with fuel sucked into the engine with respect to the stoichiometric air/fuel mixture ratio can indirectly be detected (refer to a Japanese Utility Model Registration First Publication No. Showa 63-51273 published on Apr. 6, 1986).

In the previously proposed air/fuel mixture controlling system in which the air/fuel mixture ratio is controlled in the feedback control mode according to a result of detection of the oxygen sensor, the oxygen sensor deteriorates so that the output characteristic of the detection signal with respect to the stoichiometric air/fuel mixture ratio is, from the intial stage of service, changed. Then, the actual air/fuel mixture ratio obtained by the alternate repetitions of the rich side and lean side of the air/fuel mixture ratio is not controlled in the vicinity to the target ratio (stoichiometric air/fuel mixture ratio).

A three-catalytic converter is installed in the exhaust system of a vehicular engine in order to clarify the exhaust gas. Since the three-catalytic converter exhibits best conversion efficiency when the air/fuel mixture is burned at the stoichiometric air/fuel mixture ratio, the conversion efficiency is reduced by means of the three-catalytic converter so that harmful components of CO, HC, and $NO_x$ are increased in the exhaust gas when the air/fuel mixture ratio controlled in the feedback mode due to the deterioration of the oxygen sensor deviates from the stoichiometric air/fuel mixture ratio.

In the case where almost no change in the static characteristic in the oxygen sensor is found and a response time of the oxygen sensor becomes changed from the initial stage, when, e.g., the actual air/fuel mixture ratio is reversed from the rich side to the lean and vice versa, a control point of the air/fuel mixture ratio intially and thereafter deviates from the stoichiometric air/fuel mixture ratio so that sufficient exhaust purification effect cannot be achieved any more by means of the three-catalytic converter.

Examples of characteristic changes due to the deterioration in the oxygen sensor will be described below (refer to FIGS. 10 to 13).

In a case where a slight thermal deterioration occurs in the zirconia constituting the oxygen sensor of the well known zirconia tubular type oxygen sensor, the characteristic is shifted toward the rich side with respect to the initial output characteristic and the response characteristic is such that the response from the rich state to the lean state becomes fast as compared with that at the initial stage, as shown in Table I, and the control frequency becomes high. Therefore, since the oxygen sensor is used to perform feedback control, the air/fuel mixture ratio is controlled toward the richer air/fuel mixture ratio rather than toward the stoichiometric air/fuel mixture ratio. In addition, as the thermal deterioration proceeds, the output at the rich side is reduced. Consequently, since the characteristic of the output signal is step with the stoichiometric air/fuel mixture ration as the boundary, the control frequency becomes smaller so that the response speed becomes slower.

TABLE I

| | Output R | Output L | Con. Fre. | response balance (FIG. 14) | A/Fr. C.P. |
|---|---|---|---|---|---|
| Small thermal deterioration | — | — | f. | ①, b | R. |
| Inside thermal deterioration | low | low | — | ①, a | R. |
| outside clogging | — | high | s. | ①, c or d | L. |
| Large thermal deterioration | low | — | s. | ② or ③, a | L. |

On the other hand, in a case where the zirconia tube type oxygen sensor is used, the air is introduced toward the inner side of the zirconia tube and the electromotive force is generated according to the ratio between the oxygen concentration in the air and oxygen concentration in the exhaust gas, the electrode installed in the inner side of the tube deteriorates and a clog in a protective layer protecting the zirconia tube from the exhaust gas occurs. At this time, the sensor output characteristic is changed so as to not indicate steep change and so as to have a more flat change. (Refer to FIGS. 12 and 13).

That is to say, if the inner electrode deteriorates and electromotive force cannot be picked up sufficiently, the output voltages at the rich side or at the lean side are reduced so that the control point of the feedback control will be transferred to the rich side (refer to Table I). In addition, when the clog occurs in the protecting layer, the ratio of oxygen concentration does not become large even in the lean state, the lean output voltage becomes high. Consequently, the detection response characteristic from the rich side to the lean side becomes worse and the control point deviates from the lean side (refer to Table 1).

SUMMARY OF THE INVENTION

It is, therefore, an object of the present invention to provide a system and method for controlling an air/fuel mixture ratio in a feedback control mode in which a correction is made for the air/fuel mixture ration correction coefficient to achieve a real stoichiometric air/fuel mixture ratio when the air/fuel mixture ratio feedback controlled deviates from a target (stoichiometiric) air/fuel mixture ration according to the degree of deterioration in an oxygen sensor detecting an oxygen concentration in the exhaust gas, i.e., detecting the air/fuel mixture ratio in intake air sucked into an engine.

The above-described object can be achieved by providing a system for an internal combustion engine, comprising: a) first means for detecting a concentration of an engine exhaust gas component so as to determine whether an air/fuel mixture ratio of an air/fuel mixture sucked into the engine is placed at a rich side or lean side with respect to a stoichiometric air/fuel mixture ratio; b) second means for setting an air/fuel mixture ration feedback correction coefficient to correct a quantity of fuel supplied to the engine on a feedback basis in response to the air/fuel mixture ratio detected by the first means so that the air/fuel mixture ratio approaches the stoichiometric air/fuel mixture ratio; c) third means for controlling the quantity of fuel supplied to the engine on the basis of the quantity of fuel corrected with the air/fuel mixture ratio correction coefficient set by the second means; and d) fourth means for detecting a degree of deterioration of the first means from an output characteristic of the first means and correcting an operating variable of the feedback correction coefficient set by the second means according to the degree of deterioration of the first means so as to compensate for the deviation of the air/fuel mixture ratio of the air mixture fuel from the correct stoichimetric air/fuel mixture ratio.

The above-described object can also be achieved by providing a system for diagnosing an oxygen sensor used for a system for controlling an air/fuel mixture ratio of an air mixure fuel sucked in an internal combustion engine, comprising: a) first means for detecting an engine operating condition and determining whether the engine has experienced a predetermined high exhaust temperature region; b) second means for determining whether the engine is operating in a steady state condition; c) third means for detecting maximum and minimum values of an output voltage of the oxygen sensor and determing whether the detected maximum and mimimum values are substantially equal to respective first predetermined values when the first means determines that the engine has experienced the predetermined high exhaust temperature region and the second means determines that the engine is operating in the steady state condition; and d) fourth means for indicating that the oxygen sensor has failed when the third means determines that either or both of the maximum and minimum values are not substantially equal to the corresponding first predetermined values.

The above described object can also be achieved by providing a method for controlling an air/fuel mixture ratio of an air/fuel mixture supplied to an internal combustion engine, comprising the steps of: a) providing means for detecting a concentration of an engine exhaust gas component so as to determine whether an air/fuel mixture ratio of an air/fuel mixture sucked into the engine is placed at a rich side or lean side with respect to a stoichiometric air/fuel mixture ratio; b) setting an air/fuel mixture ratio feedback correction coefficient to correct a quantity of fuel supplied to the engine on a feedback basis in response to the air/fuel mixture ratio detected in the step a) so that the air/fuel mixture ratio approaches the stoichiometric air/fuel mixture ratio; c) controlling a quantity of fuel supplied to the engine on the basis of the quantity of fuel corrected with the air/fuel mixture ratio correction coefficient set in the step b); and d) detecting a degree of deterioration of the means for detecting from an output characteristic of the means for detecting and correcting an operating variable of the feedback correction coefficient set by the second means according to the detected degree of deterioration so as to compensate for a deviation of the air/fuel mixture ratio of the air/fuel mixture detected by the means for detecting from the correct stoichimetric air/fuel mixture ratio.

DETAILED DESCRIPTION OF THE PREFERRED EMBODIMENTS

Reference will hereinafter be made to the drawings in order to facilitate a better understanding of the present invention.

Figure 1:
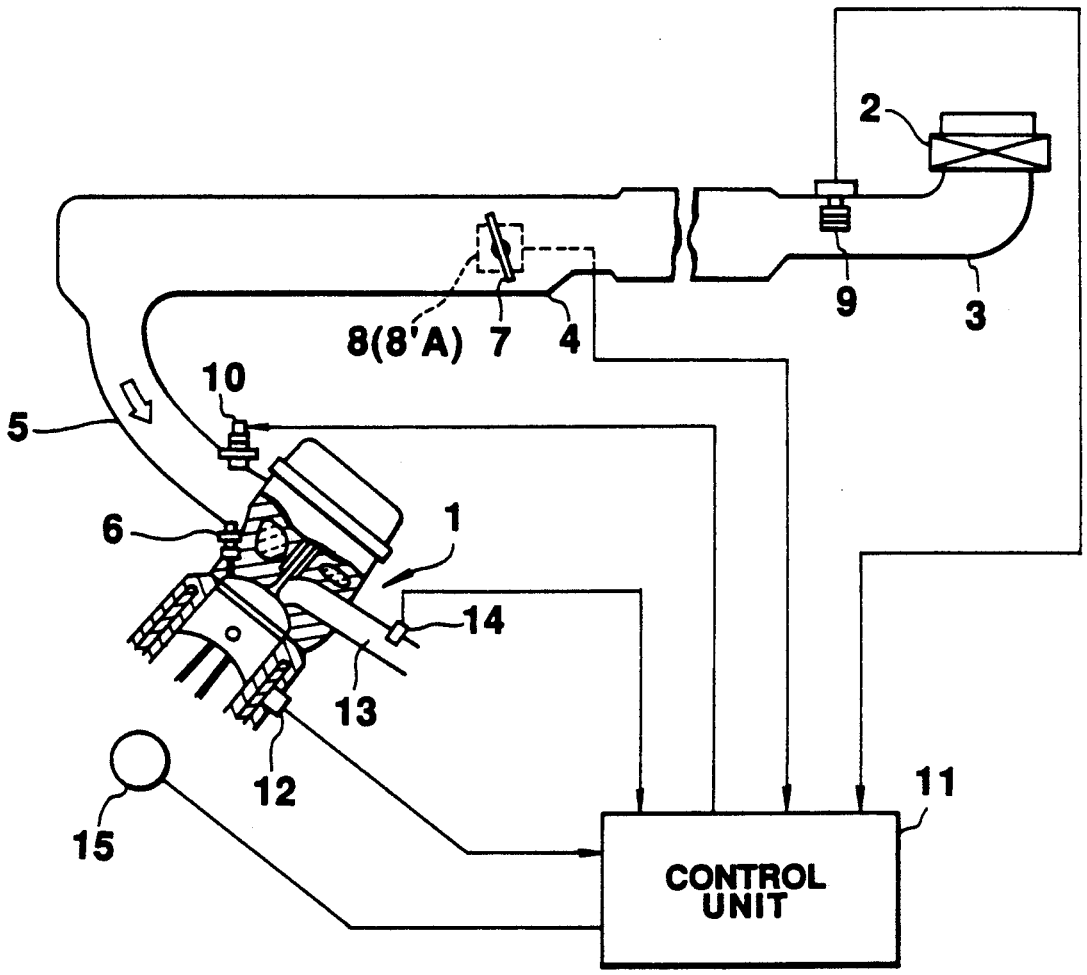
FIG. 1 is a simplified block diagram of a structure of a system for controlling an air/fuel mixture ratio for an internal combustion engine.

FIG. 1 shows a structure of a system for controlling an air/fuel mixture ratio applicable to an internal combustion engine.

In FIG. 1, intake air is sucked via an air cleaner 2, intake duct 3, throttle chamber 4, and intake manifold 5.

A throttle chamber 4 is provided with a throttle valve (butterfly type) 7 which variably controls an opening area of a throttle chamber 4 in cooperation with an accelerator pedal (not shown) so that the intake air quantity Q is controlled.

A throttle sensor 8 including an idling switch 8A which turns to ON when the throttle valve 7 is placed at a full close position (idling position) together with a potentiometer detecting an opening angle TVO of the throttle valve 7 is installed in the throttle chamber 4.

An intake duct 3 located downstream of the throttle valve 7 is provided with an airflow meter 9 detecting the intake air quantity Q of the engine 1.

The airflow meter 9 outputs a voltage signal according to the intake air quantity Q.

Each branch of an intake manifold located downstream of the throttle valve 7 is provided with an electromagnetic type fuel injection valve 10 for each engine cylinder. Each fuel injection valve 10 is opened in response to a drive pulse signal outputted in synchronization with engine revolutions from a control unit 11 in which a microcomputer to be described later is incorporated. A pressure regulator pressurized and supplied from a fuel pump (not shown) is used to supply and inject the fuel controlled under a predetermined pressure from a fuel pump (not shown) into an intake manifold 5. That is to say, the supply quantity of fuel through each fuel injection valve 10 is controlled on the basis of the duration during which the fuel injection valve 10 is opened.

A water temperature sensor 12 detecting a coolant temperature $T_w$ within a cooling jacket of the engine 1 is installed. In addition, an oxygen sensor 14 for detecting an oxygen concentration in the exhaust emission is provided within an exhaust passage 13 so that the air/fuel mixture ratio of the intake air/fuel mixture sucked into the engine 1 can be detected.

It is noted that the oxygen sensor 14 is well known as exemplified by Japanese Utility Model Registration First Publication (Zikkai) Showa 63-51273 published on Apr. 6, 1988, the disclosure of which being hereby incorporated by reference.

Air is introduced into the inside of the zirconia tube of the oxygen sensor 14 and the exhaust gas is introduced in the outside of the zirconia tube having a low concentration of oxygen. The oxygen concentration ratio between the inner side and outer side is changed according to the oxygen concentration in the exhaust gas. The oxygen sensor 14 generates an electromotive force (voltage) $V_{02}$ since the oxygen concentration ratio is large at the rich side with respect to the stoichiometric air/fuel mixture ratio due to the insufficient oxgen concentration.

On the other hand, when the oxygen concentration ratio becomes so small at the lean side with respect to the stoichiometric air/fuel mixture ratio at which the oxygen concentration becomes excessive, almost no electromotive force $V_{02}$ is generated. The oxygen sensor utilizing the above-described quality is, therefore, used to determine whether the actual air/fuel mixture ratio is placed at the rich or lean side with respect to the stoichiometric air/fuel mixture ratio. However, the sensor element is not limited to such a zirconia tube as described above. The sensor structure is not limited to the tubular type.

In addition, an ignition plug 6 is installed within each combustion chamber.

The control unit 11 counts the number of crank unit angle signals POS outputted in synchronization with the engine revolutions from a crank angle sensor 15 or measures a period of a crank reference angle signal REF (for each 180° in a case of four cylinders) outputted for each predetermined crank angular position to detect an engine revolutional speed N.

Next, a fuel supply control routine including an air/fuel mixture ratio feedback control, a diagnostic control routine of an oxygen sensor 14, and a correction control program routine of a feedback control based on a executed diagnostic result will be described with reference to flowcharts of FIGS. 2 to 7 and timing chart of FIG. 8.

Figure 2A:
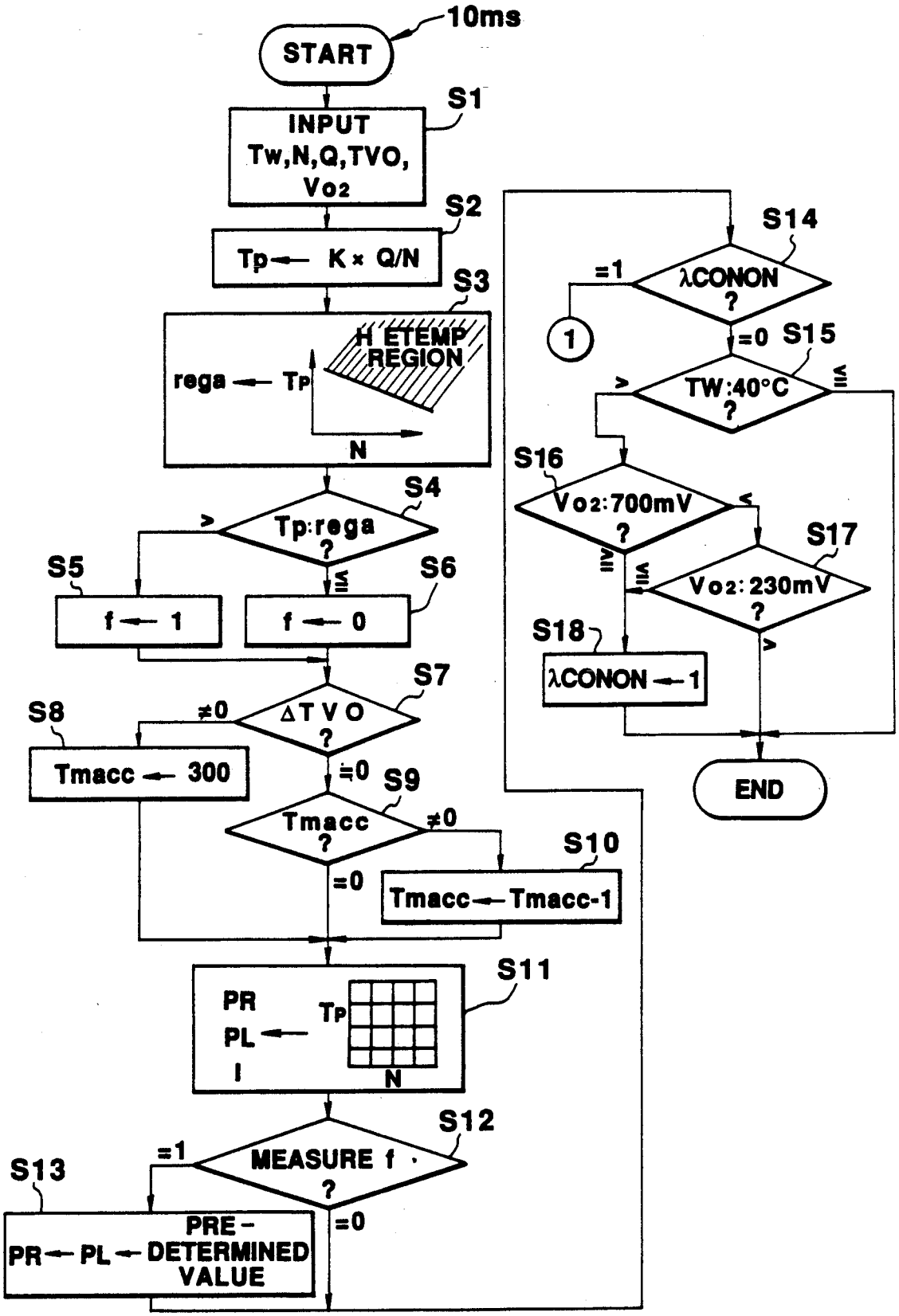
FIGS. 2 (A) through 2 (D) are integrally a program flowchart executed by the air/fuel mixture ratio controlling system shown in FIG. 1.
Figure 2:
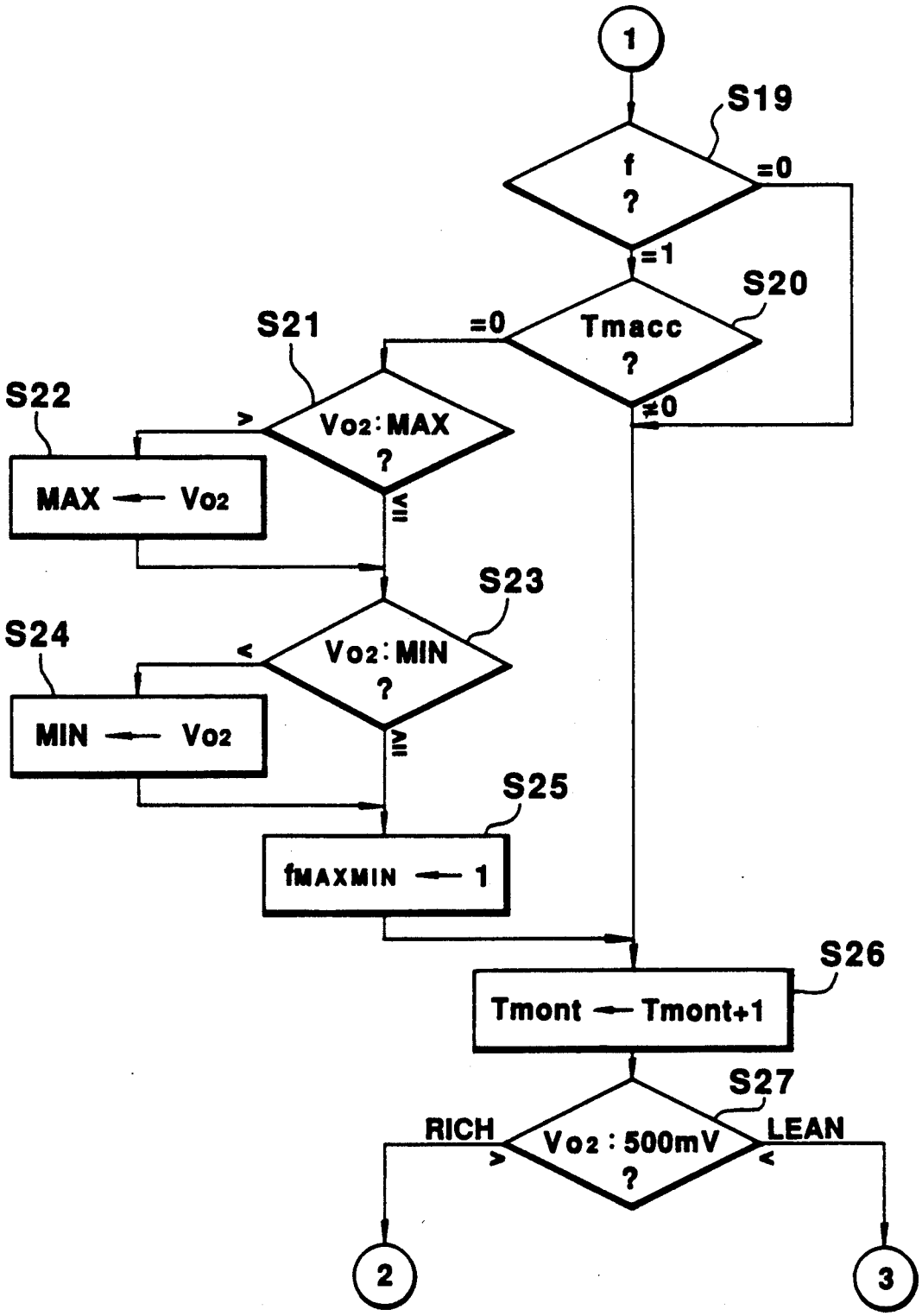
Figure 2:
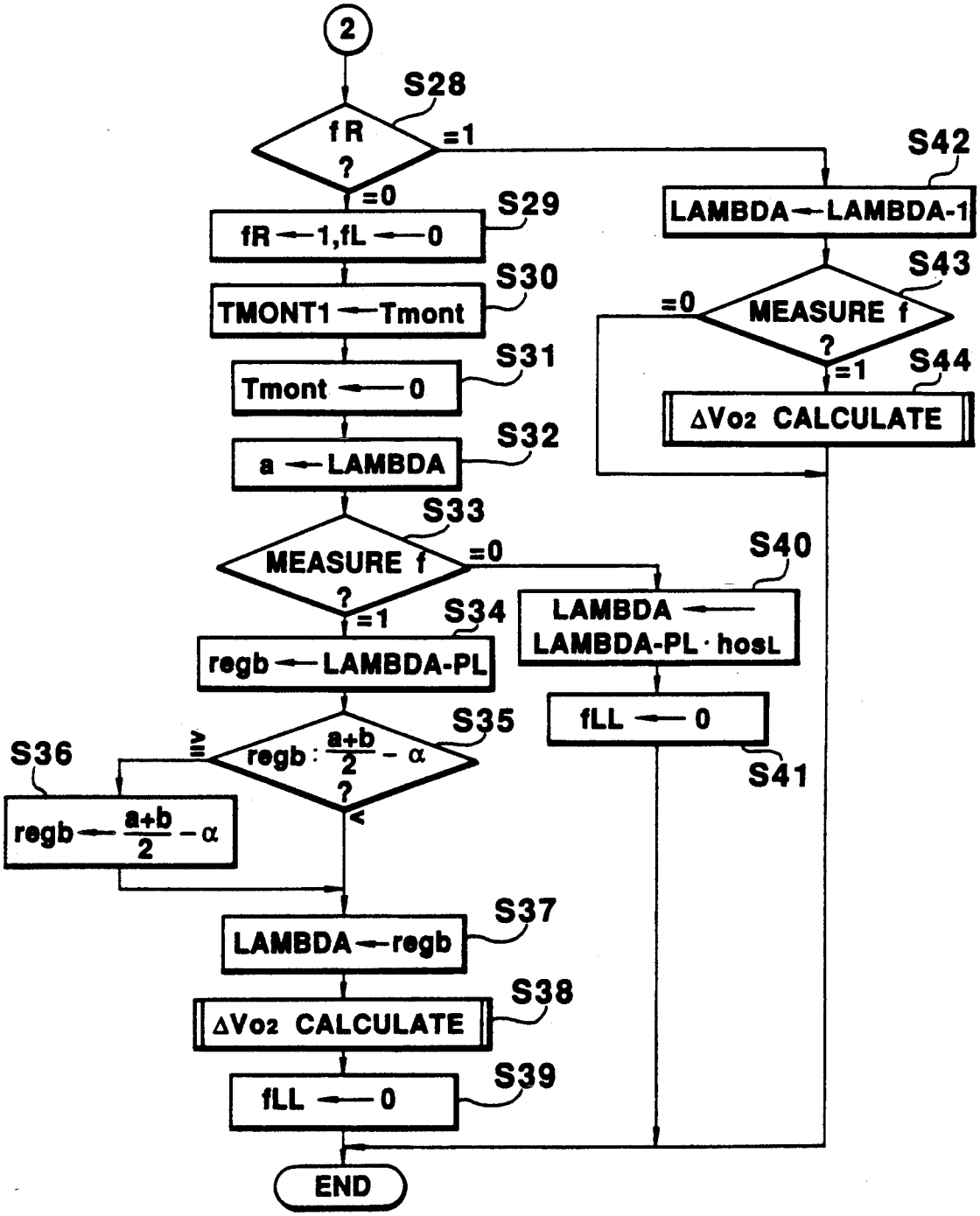
Figure 2D:
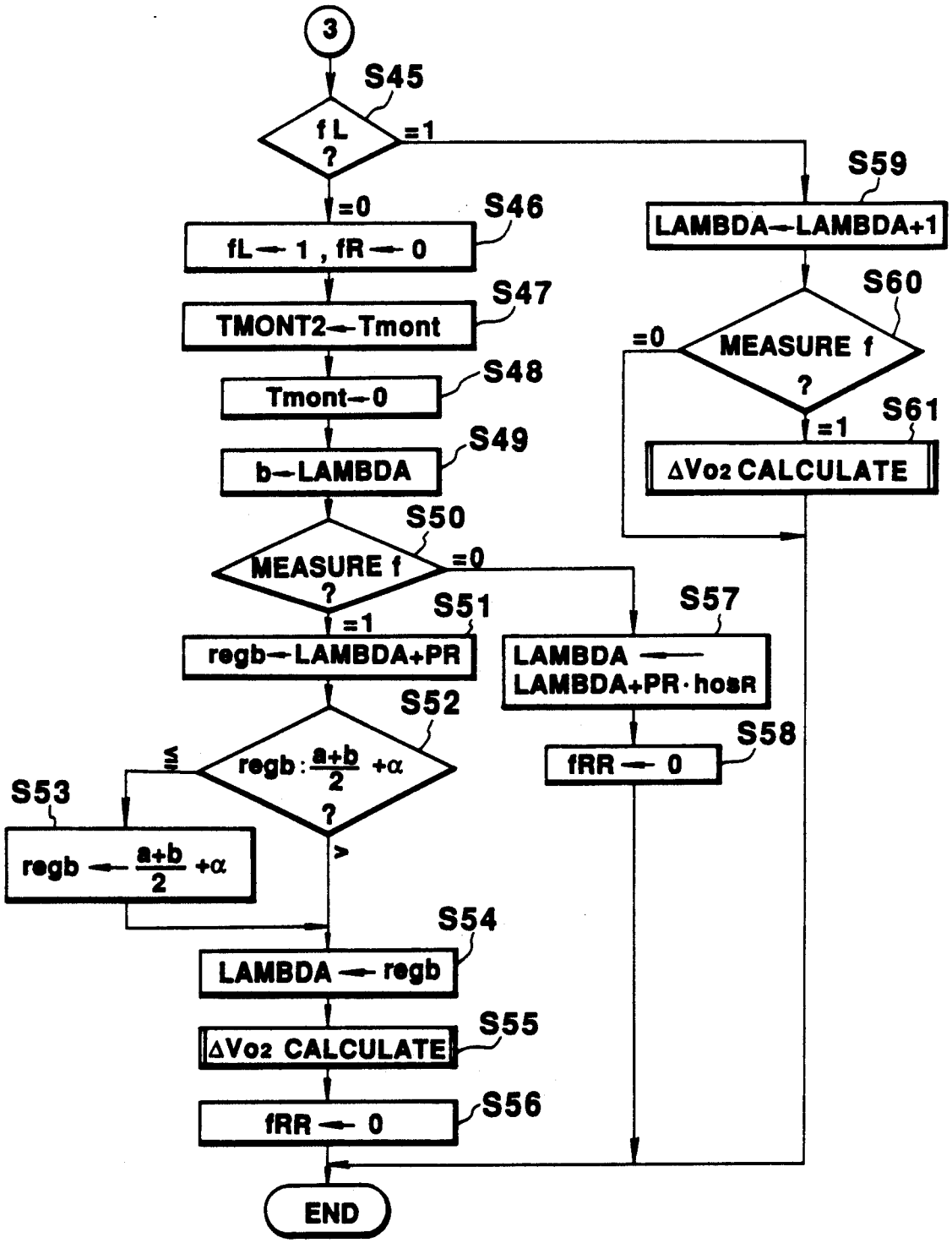

It is noted that the consecutive flowcharts shown in FIGS. 2 (A) to 2 (D) are executed whenever 10 milliseconds have passed. An air/fuel mixture ratio feedback correction coefficient LAMBDA for feedback to control the actual air/fuel mixture ratio toward a target air/fuel mixture ratio (stoichiometric air/fuel mixture ratio) is set by means of a proportional/integral control.

In a first step S1, the control unit 11 receives engine operating condition data such as the intake air quantity Q, engine revolutional speed N, output voltage $V_{02}$ of the oxygen sensor 14, engine coolant temperature $T_w$, and opening angle TVO of the engine throttle valve.

In a second step S2, a basic fuel injection quantity $T_p$ ($T_p \leftarrow K \times Q/N$, K denotes a constant) is calculated on the basis of the intake air quantity Q and engine revolutional speed N inputted in the first step S1.

In a third step S3, the control unit 11 looks up a map storing a determining basic fuel injection quantity $T_p$ to determine a predetermined high exhaust temperature region using the engine revolutional speed data N input in the first step S1 and sets the value of the determining basic fuel injection quantity $T_p$ into a register (rega), the value being a point of $T_p$ intersecting a boundary line of the predetermined high exhaust temperature region (H E TEMP REGION).

In a fourth step S4, the control unit 11 compares the (contents of) rega in which the searched basic fuel injection quantity $T_p$ in the step S3 is set with the basic fuel injection quantity $T_p$ calculated in the step S2 to determine whether the present engine operating condition falls in the predetermined high exhaust temperature region.

If the basic fuel injection quantity $T_p$ calculated on the basis of the present engine operating condition is larger than the determining one $T_p$ set in the rega, the routine goes to a fifth step S5 since the engine operating condition falls in the predetermined high exhaust temperature region. In the fifth step S5, a flag f which indicates that the engine has entered the high exhaust temperature region is set to 1. The setting of the flag f to 1 means that the predetermined high exhaust temperature region has been entered.

On the other hand, when the basic fuel injection quantity $T_p$ calculated on the basis of the present engine operating condition is below the determining $T_p$ set in the rega, the routine goes to a sixth step S6 since the engine falls in no predetermined high exhaust temperature region. In the sixth step S6, the control unit 11 determines that the flag f is set to zero (0) so that the engine has not fallen in the predetermined high exhaust temperature range.

In the next step S7, the control unit 11 determines whether a change rate Δ TVO of the opening angle TVO of the throttle valve 7 per unit time detected in the step S1 by means of the throttle sensor 8 is substantially zero so as to determine whether the engine falls in a steady state operating condition.

When the rate of change Δ TVO does not indicate substantially zero, the control unit 11 determines that the engine 1 falls in a transient operating condition in which the control unit 11 determines if the opening angle TVO of the throttle valve 7 is changing. At this time, the routine goes to an eighth step S8. In the eighth step S8, a timer value Tmacc measures a lapse time for which the engine operating condition is transferred from the transient operating state to the steady state operating state which is set to a predetermined value (e.g., 300 (milliseconds)).

On the other hand, when the rate of change Δ TVO is substantially zero, the engine falls in a steady state operating condition in which the opening angle TVO of the throttle valve 7 remains constant. At this time, the routine goes to a step S9 in which the timer value Tmacc is zero or not. If not zero, the routine goes to a step S10 in which one is substracted from the timer value Tmacc.

Hence, when the engine 1 falls in the transient operating condition, a predetermined value is set for the timer value Tmacc. When the opening angle TVO of the throttle valve 7 indicates a constant value and the engine is transferred in the steady state operating condition, one is substracted from the timer value Tmacc whenever it takes a time determined by the predetermined value from the time when the engine falls in the steady state operating condition so that the timer value Tmacc indicates zero. The control unit 11, therefore, can determine the stable steady operating condition not immediately after the transient operating condition.

In a step S11, the control unit 11 searches and determines an operating variable in a proportional/integral control from the map previously set with parameters of the engine revolutional speed N inputted in the step S1 and basic fuel injection quantity $T_p$. The operating variable to be searched in the step S11 is used to perform the proportional/integral control for the air/fuel mixture ratio feedback correction coefficient LAMBDA (feedback correction coefficient value). The control unit 11, in the step S11, sets a rich control proportional coefficient PR to increase the air/fuel mixture ratio feedback correction coeffcient LAMBDA when the air/fuel mixture ratio is reversed from the rich to the lean, the lean control proportional coefficient P to decrease the air/fuel mixture ratio correction coefficient LAMBDA when the air/fuel mixture ratio is reversed from the lean state to the rich state, and an integral coefficient I to perform an integral control over the air/fuel mixture ratio feedback correction coefficient LAMBDA.

In a step S12, the control unit 11 determines whether a diagnostic job for oxygen sensor 14 should be carried out.

The determination of the measurement of the flag f is to select whether the diagnostic job for the oxygen sensor 14 should be carried out. When the meaurement of flag f indicates 1, the control unit 11 selects the diagnostic routine for deterioration in the oxygen sensor 14 (control of detection of a response balance between the rich side and lean side of the oxygen sensor). When the meaurement of the flag f indicates zero, the diagnostic routine is canceled. When the deterioration diagnostic routine is carried out with the flag measurement f indicating 1, it is necessary to detect the response balance of the oxygen sensor 14 by carrying out the lean control and rich control under the same condition (same operating variable) in the proportional/integral control of the correction coefficient LAMBDA. Therefore, when the flag measurement f indicates 1, the routine goes to a step S13 in which PR and PL have the same values in place of the rich control proportional coefficient PR searched in the step 11.

On the other hand, when the flag measurement f is determined to indicate zero, the deterioration diagnostic routine of the oxygen sensor 14 is not carried out. Therefore, the control unit 11 uses the rich control proportional coefficient PR and lean control proportional coefficient PL since no diagnostic routine for deterioration of oxygen sensor 14 is carried out. For the setting exchange of the measurement flag f, a detailed explanation thereof will be made hereinbelow.

In the preferred embodiment, the routine for deterioration diagnosis of the oxygen sensor 14 and the ruotine of normal air/fuel mixure ratio control are switched for each predetermined time.

In the next step S14, the control unit 11 determines which bit state of a flag used for determining an initial engine operating condition $\lambda_{conon}$ indicates, the flag thereof being set to 1 when the initial engine operating condition to start the air/fuel mixture ratio feedback control is satisfied. The flag $\lambda_{conon}$ is set to zero during an intialization after a period after power is supplied to the control unit 11 (when an ignition switch (IG/SW) is turned to ON in accordance with a program flowchart shown in FIG. 6 (refer to a step S163).

It is noted that the air/fuel mixture ratio feedback control is not executed unless the flag $\lambda_{conon}$ is set to 1.

When the control unit 11 determines that the flag $\lambda_{conon}$ is set to zero in the step S14, the routine goes to a step S15 to confirm the initial condition since the feedback control is still not satisfied.

In the step S15, the control unit 11 compares the coolant water temperature $T_w$ detected by the water temperature sensor 12 with a predetermined temperature (,e.g., 40° C.).

When the engine falls in a cooled state in which the coolant temperature $T_w$ is below the predetermined temperature, the program is ended and the flag $\lambda_{conon}$ remains zero.

On the other hand, in a state where the coolant temperature $T_w$ exceeds the predetermined temperature, the routine goes to a step S16 in which the control unit 11 determines whether the oxygen sensor 14 is in an activation state capable of outputting a voltage range required to detect the actual air/fuel mixture ratio by means of the oxygen sensor 14.

In the step S16, the control unit 11 determines the output voltage $V_{o2}$ of the oxygen sensor 14 with a predetermined voltage (,e.g., 700 mV) at the rich side to determine whether the oxygen sensor 14 outputs a sufficient voltage to determine the rich side of the air/fuel mixture ratio.

When the output voltage $V_{o2}$ is above the predetermined voltage, the control unit 11 confirms that the oxygen sensor 14 outputs at least the voltage $V_{o2}$ at the rich side. Since the control unit 11 estimates that the oxygen sensor 14 can spontaneously output for the rich side, the routine goes to a step S18 in which the flag $\lambda_{conon}$ is set to 1. A setting control of the air/fuel mixture ratio feedback correction coefficient LAMBDA is carried out from the next stage.

When the output voltage $V_{o2}$ at the rich side does not output, the routine goes to a step S17 in which the output voltage $V_{o2}$ is compared with a predetermined voltage (,e.g., 230 mV) at a lean side. Similarly, the control unit 11 determines whether the oxygen sensor 14 provides a sufficient voltage to give the lean side determination. When a lower voltage than the lean side predetermined voltage is outputted, the control unit 11 determines that a state in which it is usable for the air/fuel mixture ratio detection. Then, in a step S18, the flag $\lambda_{conon}$ is set to 1.

On the other hand, when the output voltage $V_{o2}$ of the oxygen sensor 14 outputs only a value in the vicinity to a slice level voltage (, e.g., 500 mV) to determine a stoichiometric air/fuel mixture ratio, the program is ended with the flag $\lambda_{conon}$ being set to zero.

When the initial condition is confirmed upon start of the feedback control with the flag $\lambda_{conon}$ set to 1, the routine goes from a step S14 to a step S19.

In the step S19, the determination of flag f set so as to determine whether the present operating condition falls in the predetermined high temperature exhaust temperature region (H E TEMP REGION) is carried out. If the flag f indicates 1 and the engine falls in the predetermined high exhaust temperature region, the routine goes to a step S20.

In the step S20, the control unit 11 determines whether the timer value Tmacc indicates zero. If the timer value Tmacc indicates zero and the engine 1 falls in a stable driving (steady state operating) condition, the routine goes to a step S21.

In the step S20, the control unit 11 determines whether the timer value Tmacc is zero or not.

In the step S21, the control unit 11 compares MAX in which the maximum output value of the oxygen sensor 14 is set with the output voltage $V_{o2}$ of the present oxygen sensor 14. If the present output value exceeds MAX, the routine goes to a step S22 in which the present output value is set to MAX to update MAX.

In a step S23, the control unit 11 compares MIN in which the minimum output value of the oxygen sensor 14 is set with the present output voltage $V_{o2}$ of the oxygen sensor 14. If the present output value is below the value of MIN, the routine goes to a step S24 in which the present output value is set to MIN to update MIN.

Figure 6:
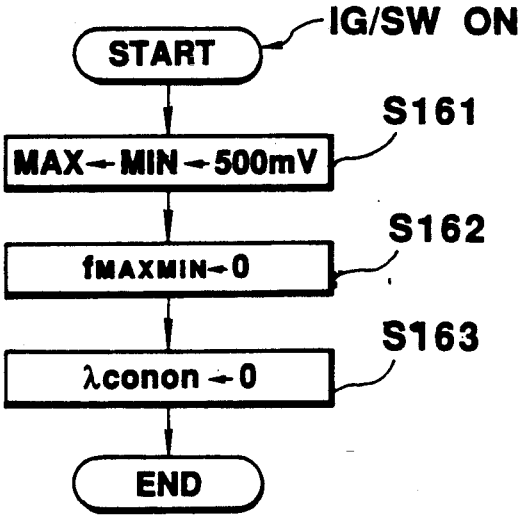
FIG. 6 is a program flowchart executed by the air/fuel mixture ratio controlling system shown in FIG. 1.

It is noted that since the maximum value MAX and minimum value MIN are respectively set to a substantially center value (,e.g., 500 mV) of an output range which is a slice level corresponding to the stoichiometric air/fuel mixture ratio when the ignition switch is turned to ON in accordance with a program of a flowchart of FIG. 6 (refer to a step S161). Since in the predetermined high exhaust temperature region both MAX and MIN are updated sequentially, both MAX and MIN are sampled when the engine falls in the predetermined high exhaust temperature region and is driven in the steady state condition.

In the next step S25, a flag $f_{maxmin}$ to determine whether the high temperature region has been entered is set to 1. Since the flag $f_{maxmin}$ is set to zero when the ignition switch is turned to ON in accordance with the program shown in the flowchart of FIG. 6 (refer to a step S162), the flag $f_{maxmin}$ is set to 1 only when the engine falls in the predetermined high exhaust temperature region (H E TEMP REGION) and in the stable steady state driving condition and advances to a step S21.

On the other hand, when the engine 1 does not fall into the high exhaust temperature region in which the flag f indicates zero, the routine jumps steps S21 to S25 and advances to a step S26 when the engine 1 falls in a transient operating condition in which the value of timer Tmacc does not indicate zero in a step S20.

In a step S26, a timer value $T_{mont}$, which is reset to zero only when the air/fuel mixture ratio is at first reversed to the rich side or lean side with respect to the stoichiometric air/fuel mixture ratio, is incremented by one. The timer value $T_{mont}$ can measure a lapse time upon reversal of the air/fuel mixture ratio with respect to the stoichiometric air/fuel mixture ratio.

In a step S27, the control unit 11 compares the slice level voltage (,e.g., 500 mV) corresponding to the stoichiometric air/fuel mixture ratio which is the target air/fuel mixture ratio (the substantially center value of the voltage range over which the oxygen sensor 14 normally outputs) with the output voltage $V_{o2}$ of the oxygen sensor 14. Thus, the control unit 11 determines whether the actual air/fuel mixture ratio is rich with respect to the stoichiometric air/fuel mixture ratio.

When the output voltage $V_{o2}$ is higher than the slic level voltage, the high voltage is outputted due to the lack of oxygen since the air/fuel mixture ratio is rich. At this time, the routine goes to a step S28.

In the step S28, the control unit 11 determines whether the determination of rich or lean is the first time to be carried out on the basis of a flag fR. Since the flag fR is set to zero when the lean air/fuel mixture ratio is detected as will be described later. If the present rich detection is the first time, the routine goes to a step S29 determining that the flag fR is determined to be zero.

In a step S29, 1 is set to the flag fR and zero is set to a flag fL by which the lean air/fuel mixture ratio is first detected.

In a step S30, a value of the timer Tmont, counted up during the lean air/fuel mixture ratio detection and which is reset to zero as will be described later upon the first detection of the lean air/fuel mixture ratio, is set to a TMONT1 (lean conrrol duration) indicating a duration of time during which the air/fuel mixture ratio is lean.

In a step S31, the timer value Tmont is reset to zero and a lapse time upon the first detection of the rich air/fuel mixture ratio is detected by the timer value Tmont.

In a step S32, the value of the present air/fuel mixture ratio feedback correction coefficient LAMBDA is set to a maximum value a. Since the air/fuel mixture ratio is determined to be rich until the previous time. The air/fuel mixture ratio feedback correction coefficient LAMBDA is increased. Since upon the reception of the present rich detection, it is, in turn, decreased, the air/fuel mixture ratio feedback correction coefficient LAMBDA takes the maximum value before the decrease control is carried out at the first time when the rich detection is carried out.

In a step S33, the determination of the flag f measurement is carried out. When the normal feedback control is carried out, the measurement of flag f indicating zero, the routine goes to a step S40 in which the value of the lean control proportional coefficient PL searched on the basis of the basic fuel injection quantity $T_p$ and engine revolutional speed N in the step S11 which is multiplied by the lean control correction coefficient hosL is subtracted from the previously derived air/fuel mixture ratio feedback correction coefficient LAMBDA so that the decrease setting due to the proportional operation of the correction coefficient LAMBDA is carried out. Consequently, a new correction coefficient LAMBDA is set. It is noted that the control correction coefficient hosL is used to correct the average air/fuel mixture ratio when the average air/fuel mixture ratio does not indicate the value in the vicinity to the stoichiometric air/fuel mixture ratio due to imbalance between the rich range and lean range in the feedback control. The detailed description will follow.

In a step S41, a flag fLL indicating whether a decremental change in the output voltage of the oxygen sensor 14 occurs at first and used during the deterioration diagnostic of the oxygen sensor 14 is reset to zero and the program is ended.

On the other hand, when the control unit 11 determines that the flag f measurement indicates 1, the routine goes to a step S34 after of which processing for the deterioration diagnosis of the oxygen sensor 14 is executed.

In the step S34, a lean control proportional coefficient PL in which a predetermined value which is the same as the rich control proportional coefficient PR executed in the step S13 to execute the deterioration diagnosis for the oxygen sensor 14 is subtracted from the previous air/fuel mixture ratio feedback correction coefficient LAMBDA to set a decremental proportional operation of the correction coefficient LAMBDA so that the derived correction coefficient LAMBDA is set in a register regb.

In a step S35, the control unit 11 compares the value of the average value (center value) of the correction coefficient LAMBDA derived as the average value with respect to the maximum value b derived at the first time of the air/fuel mixture ratio detection in the same way as the maximum of the correction coefficient LAMBDA derived in the step S32 with the regb derived in the step S34. If the control unit 11 determines that the contents of regb is larger, the routine goes to a step S36 in which $(a+b)/2-d$ is updated and set in the regb and the routine goes to a step S37.

On the other hand, if in the step S35 the value of regb is determined to be smaller, the routine goes directly to a step S37.

In the step S37, the correction coefficient LAMBDA is set as the LAMBDA finally used for the fuel correction.

That is to say, since the air/fuel mixture ratio feedback correction coefficient LAMBDA is proportionally and intergally controlled on the basis of the determination of rich or lean of the actual air/fuel mixture ratio with respect to a target air/fuel mixture ratio so that the actual air/fuel mixture ratio is varied with the stoichiometric air/fuel mixture ratio as a center, thus the avarage air/fuel mixture ratio being controlled to the target air/fuel mixture ratio.

Therefore, the average value is actually the corection coefficient required to obtain the target air/fuel mixture ratio. Since, at this time, the control unit 11 detects that the air/fuel mixture ratio is reversed to the rich side, the fuel supply quantity is required to decrease by decreasing the air/fuel mixture ratio correction coefficient LAMBDA. However, if the feedback correction coefficient LAMBDA is controlled to indicate a value below $(a+b)/2$ corresponding to the target air/fuel mixture ratio, the rich state of the air/fuel mixture ratio could be eliminated.

However, although the air/fuel mixture ratio correction coefficient LAMBDA is proportionally controlled on the basis of the lean control proportional coefficient PL in which the predetermined value is set, the proportional control is not always carried out which can eliminate the rich state. Depending on the additional level of the proportional control, a time during which the rich state can be eliminated is different under the same engine driving condition.

Since, in the preferred embodiment, a time during which the proportional control for the correction coefficient LAMBDA is carried out when the air/fuel mixture ratio is reversed and up to the start of change of the actually detected air/fuel mixture ratio in the direction toward the target air/fuel mixture ratio is measured to diagnose the deterioration of the oxygen sensor 14.

The air/fuel mixture ratio feedback correction coefficient LAMBDA is set which can, at least, eliminate the present air/fuel mixture ratio rich state in order to be diagnosed under the same condition.

Figure 3:
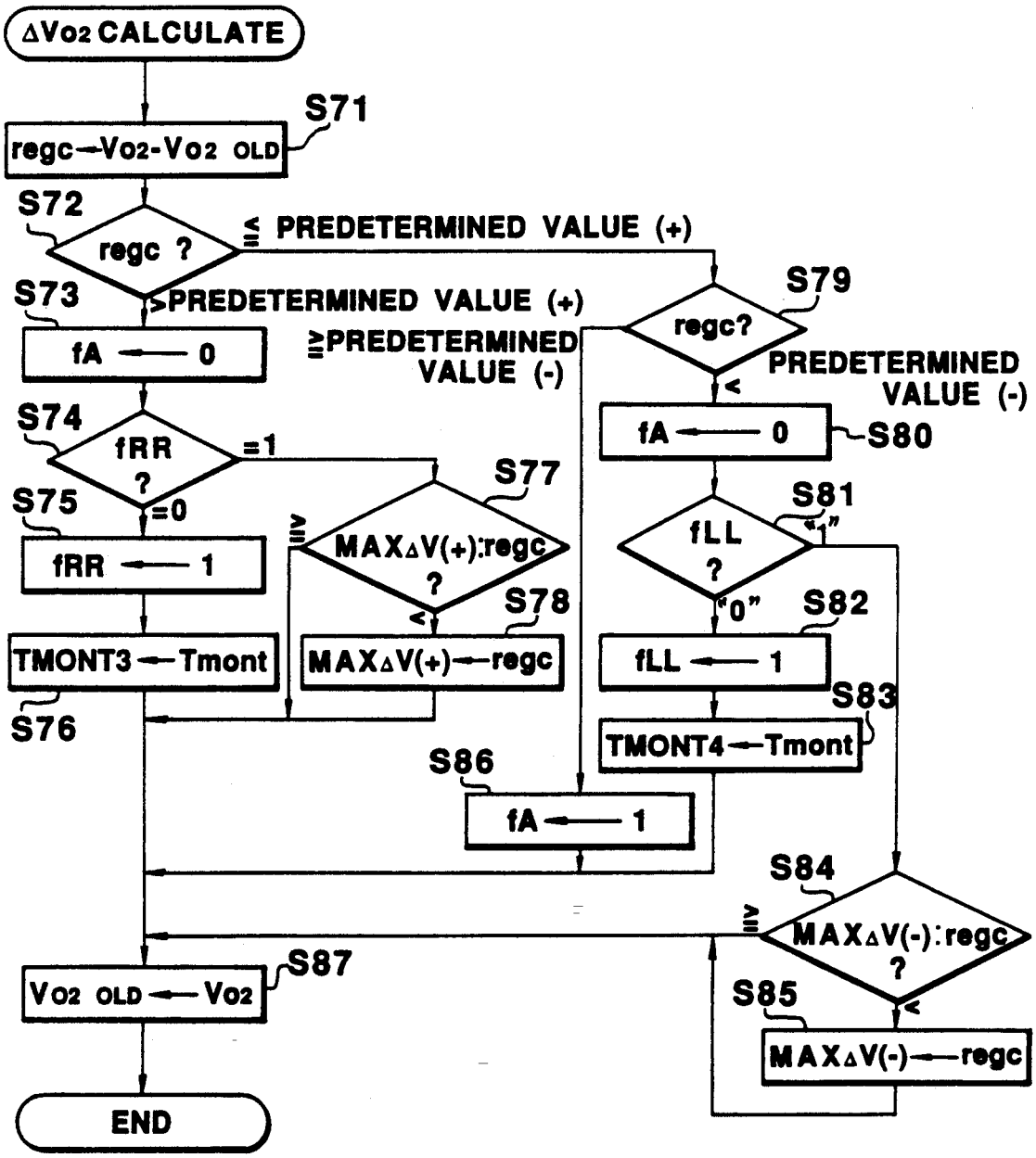
FIG. 3 is a program flowchart executed by the air/fuel mixture ratio controlling system shown in FIG. 1.

In the next step S38, the control unit 11 performs the calculation of change quantity $V_{o2}$ per unit time of the output voltage $V_{o2}$ of the oxygen sensor 14 as shown in the flowchart of FIG. 3.

At first, in a step S71, the control unit 11 subtracts the output voltage $V_{o2}$ inputted during the previous execution (10 mS) from the output voltage $V_{o2}$ of the oxygen sensor 14 inputted in the present step SI to derive a change quantity $V_{o2}$ per unit time (10 mS). Its result is set in the regc.

In a step S72, the control unit 11 compares the value of regc in which the latest change quantity $V_{o2}$ is set in the step S71 with a predetermined value (+) to determine whether the output voltage $V_{o2}$ of the oxygen sensor 14 is increased at a rate exceeding a predetermined value.

When the regc is determined to exceed the plus predetermined value (+), the routine goes to a step S73 in which a flag fA to determine whether the output voltage $V_{o2}$ is substantially constant is set to zero. The indication of flag fA can determine that the output voltage $V_{o2}$ can be changed.

In the next step S74, the control unit 11 determines a state of a flag fRR indicating whether the incremental change first occurs. The flag fRR determining that the incremental change first occurs is reset to zero at the first time when the lean air/fuel mixture ratio occurs. Thereafter, 1 is set at the first time when the control unit 11 detects that the output voltage $V_{o2}$ is incrementally changed at the rate exceeding the predetermined value.

Hence, the flag fRR determined to be zero in a step S74 indicates that the output voltage $V_{o2}$ is first changing in the incremental direction from the first time of detection of the lean air/fuel mixture ratio. Therefore, when the control unit 11 determines that the flag fRR is zero in the step S74, 1 is set to the flag fRR in the step S75 in order to determine that the first detection thereof is already carried out. In the next step S76, the control unit 11 sets a timer value Tmont to TMONT3 measuring the lapse time after the zero reset thereof at the first time of the lean detection. Thus, TMONT3 represents a time of duration during which the air/fuel mixture ratio is started to change in the rich direction from the first time of lean detection (a time it takes from the reversal of the air/fuel mixture ratio to the lean side to the start of time at which the air/fuel mixture ratio starts to change in the direction of the stoichiometric air/fuel mixture ratio).

On the other hand, when the control unit 11 determines that the flag fRR indicates 1 in the step S74, the routine goes to a step S77 in which the control unit 11 compares a regc in which a change rate $\Delta V_{o2}$ detected in the step S71 is compared with a maximum change quantity $\Delta V(+)$ at the plus side.

Figure 4A:
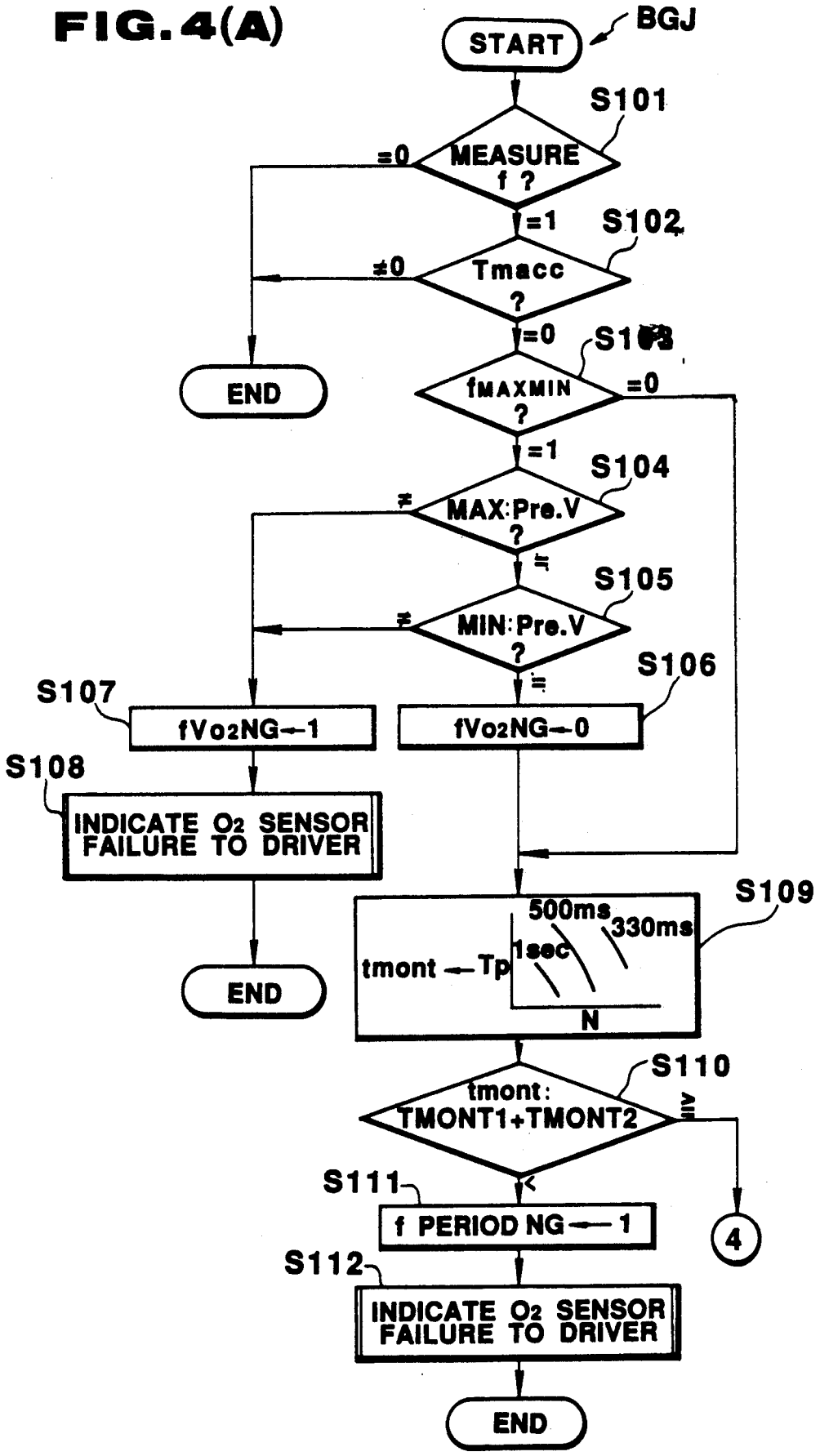
FIGS. 4 (A) and 4 (B) are integrally a program flowchart executed by the air/fuel mixture ratio controlling system shown in FIG. 1.
Figure 4:
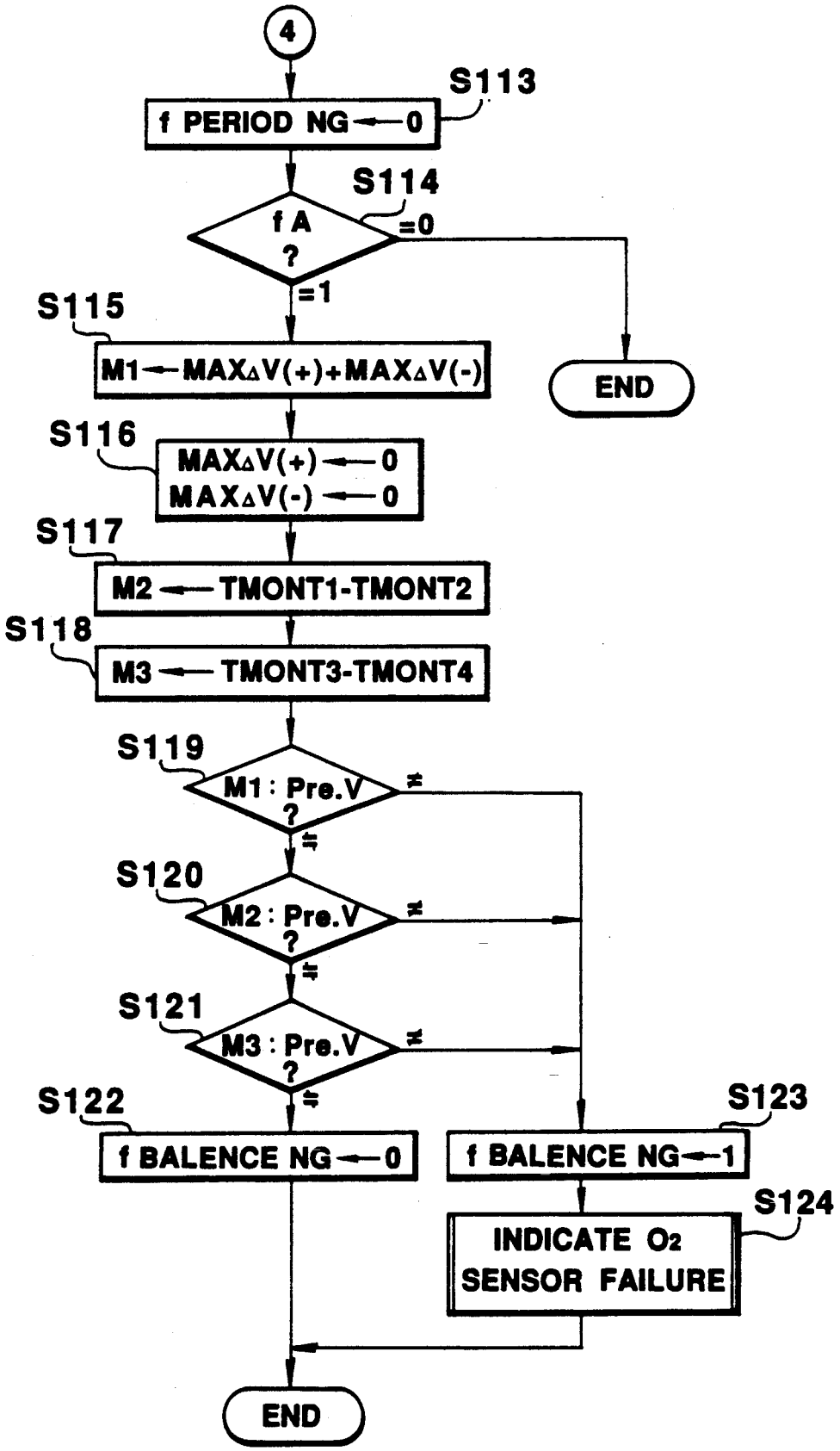

The maximum change rate $\Delta V(+)$ at the plus side is reset to zero in the flowchart of FIGS. 4 (A) and 4 (B). Therefore, the maximum value of the change quantity $\Delta V_{o2}$ of the output voltage is set. When the control unit 11 determines that the regc in which $\Delta V_{o2}$ presently sampled is set is larger than the maximum change rate $\Delta V(+)$ at the plus side derively previously, the routine goes to a step S78 in which the regc is updated to $\Delta V(+)$.

In a step S87, the output voltage $V_{o2}$ inputted in the present step S1 is set to a previous value of $V_{o2old}$ in order to calculate the next rate of change $\Delta V_{o2}$ (regc).

On the other hand, when the control unit 11 determines that the regc is below the plus predetermined value, the routine goes to a step S79 in which a value of regc is compared with a minus (−) predetermined vlaue in order to determine whether the output voltage $V_{o2}$ of the oxygen sensor 14 is decreased at a predetermined value exceeding a predetermined value.

When the control unit 11 determines that the regc is below the minus (−) predetermined value, the routine goes to a step S80. In the step S80, the flag fA to determine whether the output voltage $V_{o2}$ is substantially constant is set to zero. The flag fA can determine whether the output voltage $V_{o2}$ is changed.

In the next step S81, the flag fLL indicating whether the decremental change in the air/fuel mixture ratio first occurs is determined.

The flag fLL is reset to zero when the lean detection first occurs. Thereafter, 1 is set to the flag fLL at the first time when the output voltage $V_{o2}$ is detected at the rate exceeding the predetermined value.

Hence, when the control unit 11 determines that the flag fLL indicates zero in the step S81, the output voltage $V_{o2}$ is first changing in the decrease direction at the first time when the lean detection occurs. Therefore, when determining that the flag fLL is zero in the step S81, 1 is set to the flag fLL in the step S82 so as to determine whether the first detection is ended. In the next step S83, a timer value Tmont is set to TMONT4 which measures a lapse time after reset to zero at the first occurrence of lean detection. The TMONT4 represents a time it takes from the first occurrence of the lean detection to the start of the change of the air/fuel mixture ratio in the lean direction (the time it takes from the reversal of the air/fuel mixture ratio to the rich state to the start of the change of the air/fuel mixture ratio toward the target air/fuel mixture ratio direction).

On the other hand, when the control unit 11 determines that the flag fLL indicates 1, in the step S81, the routine goes to a step S84 in which the control unit 11 compares the regc in which a change rate $V_{o2}$ detected in the present step S71 is set with a maximum change quantity $MAX\Delta V(-)$ at the minus side. The maximum change quantity $MAX\Delta V(-)$ at the minus side is reset to zero in accordance with the flowchart shown in FIG. 3 and the maximum value of the change quantity $\Delta V_{o2}$ at the minus side of the output voltage $V_{o2}$ is set. When the regc in which $\Delta V_{o2}$ presently sampled is set is determined to be smaller than the maximum change rate $MAX\Delta V(-)$ at the previous minus side, the routine goes to a step S85 in which the regc is updated to $MAX\Delta V(-)$.

In a step S79, when the control unit 11 determines that the regc is above a minus predetermined value (−), the output voltage $V_{o2}$ of the oxygen sensor 14 does not change largely in both directions of the plus side and minus side. Then, since almost no change in the output voltage occurs, 1 is set to the flag fA so that the stable state of the output voltage $V_{o2}$ can be determined.

With reference to the flowchart of FIG. 2, in the first occurrence of lean detection in which the calculation of the change quantity $\Delta V_{o2}$ of the output voltage $V_{o2}$ of the oxygen sensor 14 is carried out, the control unit 11 resets the flag fLL to zero. Then, the time (TMONT4) from the time when the output voltage $V_{o2}$ of the oxygen sensor 14 at the first occurrence of the lean detection is decreased to the time when the control unit 11 detects that the air/fuel mixture ratio is about to change in the lean direction.

After, in a step S28, the flag fR is determined to indicate 1 so that the rich detection second occurs, the integration coefficient I derived in the step S11 is substracted from the previous air/fuel mixture ratio feedback correction coefficient LAMBDA. Its result is newly set as the correction coefficient LAMBDA. Hence, until the rich state of the air/fuel mixture ratio is eliminated, the correction coefficient LAMBDA is decreased by the integration coefficient I for each 10 mS in the step S37.

In the next step S43, the control unit 11 determines the measurement flag f. Only when the flag measurement f indicates 1 and deterioration diagnosis is carried out, the routine goes to a step S44.

In the step S44, the control unit 11 carries out the execution of the flowchart shown in FIG. 3 described above so that the sampling of the change quantity $\Delta V_{o2}$ of the output voltage $V_{o2}$ of the oxygen sensor 14, the maximum value sampling of the change quantity $\Delta V_{o2}$ in both plus and minus directions, and sampling of a time (TMONT3, TMONT4) from the first occurrence of lean detection to the start of the change in the direction toward the target air/fuel mixture ratio are carried out.

On the other hand, when the control unit 11 determines that the output voltage $V_{o2}$ of the oxygen sensor 14 is smaller than the slice level corresponding to the target air/fuel mixture ratio (stoichiometric air/fuel mixture ratio) and that the air/fuel mixture ratio is lean with respect to the target air/fuel mixture ratio, the calculation processing is carried out substantially in the same way as when the rich detection is carried out. Therefore, a breif description thereof will follow. The following description corresponds to the steps S45 to S65 in the flowchart of FIG. 2.

That is to say, during the first occurrence of lean detection the value of Tmont to measure the lapse time from the time when it is reset to zero at the first occurrence of the lean detection is set to TMONT2, the TMONT2 indicating the rich detection duration.

In addition, since the air/fuel mixture ratio correction coefficient LAMBDA must have a lower peak value during the first occurrence of the lean detection, the peak value is set to b and the air/fuel mixture feedback correction coefficient LAMBDA corresponding to the target air/fuel mixture ratio is derived from the average of the value of b and the peak value a of an upper part first sampled during the rich detection. During the deterioration diagnosis (when the flag measurement f is 1), the correction coefficient LAMBDA larger than the value corresponding to the target air/fuel mixture ratio is set in the proportional control mode. In the proportional control during the first occurrence of the lean detection, the correction coefficient LAMBDA which can substantially eliminate the lean state is set.

In addition, the integration coefficient I is added to the air/fuel mixture ratio feedback correction coefficient LAMBDA after the second and subsequent occurrences of the lean detection. The incremental correction by means of the integration coefficient I is continuously carried out until the lean state is eliminated and the air/fuel mixture ratio is reversed to the rich state.

Furthermore, during the deterioration diagnosis, the control unit 11 calculates the change rate $\Delta V_{o2}$ of the output voltage $V_{o2}$ shown in the flowchart of FIG. 3 is carried out and the sampling of the time (TMONT3) until the maximum change rate is calculated and the air/fuel mixture ratio is started to change in the lean direction from the first occurrence of lean detection is carried out.

FIGS. 4 (A) and 4 (B) show intergally a diagnostic program for the oxygen sensor 14.

It is noted that the program shown in FIGS. 4 (A) and 4 (B) is processed in a background mode (BGJ). It is also noted that the term background processing (BGJ) means a work (job) which has a low priority and is handled by the computer when higher priority or real-time entries are not occurring. Batch processing such as inventory control, payroll, housekeeping, etc., are often treated as background processing but can be interrupted on orders from terminals or inquiries from other units.

In a step S101, the control unit 11 determines the flag measurement f. The processing after the step S102 is carried out only when the flag measurement f indicates 1.

In a step S102, the control unit 11 determines the timer value Tmacc. The subsequent calculation processing is carried out only when the timer value Tmacc indicates zero and the engine is in the stable operating state. This is because when the engine is in the transient state, the air/fuel mixture ratio is largely lean or rich due to the response delay of the liquid fuel supplied along a wall surface of the intake passage of the engine so that the controlled state of the correction coefficient LAMBDA on the basis of the change in the air/fuel mixture ratio is sampled to avoid an errorneous diagnosis of the deterioration of the oxygen sensor 14.

When the timer value Tmacc indicates zero and the engine 1 is in the stable stady state, the routine goes to a step S103 in which the state of flag $f_{MAXMIN}$ is determined. The flag $f_{MAXMIN}$ is reset to zero when the ignition switch is turned to ON, as described above. Thereafter, the flag $f_{MAXMIN}$ is set to 1 when the predetermined high exhaust temperature region (H E TEMP REGION) has been entered. In the predetermined high exhaust temperature region, the maximum value MAX and minimum value MIN of the output voltage $V_{o2}$ of the oxygen sensor 14 are sampled. Then, the routine goes to a step S104 in which the control unit 11 determines whether an intial value has been sampled as the maximum value MAX and minimum vlaue MIN. The control unit 11 diagnoses the faulty deterioration of the oxygen sensor 14 on the basis of the determination result.

That is to say, the oxygen sensor 14 outputs the maximum value and minimum value of the substantially constant level according to the rich and lean states of the air/fuel mixture ratio when the engine indicates the exhaust gas temperature is exceeding the predetermined value. Therefore, if the control unit 11 compares the initial value with the detected maximum and minimum vlaues, the control unit 11 can determine whether the output level of the oxygen sensor 14 is abnormal.

Hence, in the step S104, the control unit 11 compares the maximum value MAX sampled in the predetermined high exhaust temperature region with the predetermined vlaue (initial value) corresponding to the maximum value at the initial state. If the sampled maximum value MAX is not substantiall equal to the initial value, the routine goes to a step S107 in which a flag $fV_{o2}NG$ indicating whether the output level of the oxygen sensor 14 is abnormal and is set to 1. (the set of 1 means the abnormality occurs in the output level of the oxygen sensor 14).

In the next step S108, the control unit 11 informs the vehicle driver that the oxygen sensor 14 has a failure through a display unit on a vehicular dashboard.

In addition, when, in the step S104, the control unit 11 determines that the maximum value MAX is substantially equal to the intial value, the routine goes to a step S105 in which the sampled minimum value MIN is compared with the initial value of the minimum vlaue. When the minimum value MIN is different from the intial value, the routine goes to a step S107 in the same way as the case where the maximum value MAX is different from the initial one in which the flag $fV_{o2}NG$ is set to 1 and, thereafter, the routine goes to the step S108 in which the failure of the oxygen sensor 14 is communicated to the driver.

On the other hand, when both maximum value MAX and minimum value MIN are determined to be equal to the initial value, the routine goes to the step S106 in which the flag $fV_{o2}NG$ is set to zero. The flag $fV_{o2}$ is used to determine whether no abnormality in the output level of the oxygen sensor 14 is recognized.

The initial stage of the output voltage $V_{o2}$ is caused by the deterioration of the inner side (atmospheric air side) of the oxygen sensor 14 of the zirconia tube type and/or by the clogging of the protective layer protecting the outer side of the zirconia tube.

As described above, after the output level of the oxygen sensor 14 is diagnosed, the control unit 11 checks the time of the control period after a step S109.

In the step S109, the control unit 11 searches the initial value of the control period on the corresponding driving condition from the initial value map of the control period previously set according to the engine revolutional speed N and basic fuel injection quantity $T_p$ (engine load).

In the next step S110, the control unit 11 compares one period of time of control derived by the addition of lean duration (rich control duration) TMONT1 and the rich duration (lean control duration) TMONT1 with the initial value of the one period of time searched and found from the map in the step S108. When the control period is longer than the initial value, a flag f period NG is set to 1 in a step S111. The flag f period NG is used to determine the abnormality of the control period. In the next step S112, the control unit 11 informs the driver of the failure in the oxygen sensor 14 via the display unit.

The reason that the control period is longer than the initial value is that, as shown in Table I, the generation of clogging in the protection layer intervening between the exhaust gas of the air to be detected and sensor element and/or generation of thermal deterioration in the zirconia constituting the sensor element.

On the other hand, if the control unit 11 determines that the control period does not become longer as compared with the initial stage, the routine goes to a step S113 in which the flag f period NG is set to zero. The flag f period NG serves to determine whether the control period is normal.

In the next step S114, a state of the flag fA is determined. If the flag fA is zero and output voltage $V_{o2}$ of the oxygen sensor 14 is substantially constant, the routine goes to a step S115 to diagnose the oxygen sensor 14.

In the step S115, the control unit 11 adds the maximum value MAX$\Delta$ V(−) at the minus side to the maximum value MAX$\Delta$ V(+) of the plus side quantity of change $V_{o2}$ of the output voltage $V_{o2}$ sampled in accordance with the calculation program of $V_{o2}$ of FIG. 3. The result is set to M1.

In the next step S119, the control unit 11 compares a value of M1 indicating a difference between the change speeds when the output of oxygen sensor 14 is changed in the incremental direction and is changed in the decremental direction with the predetermined value corresponding to the initial value of the M1. Then, the control unit 11 determines wether the change speeds are changed with respect to the initial value.

When the control unit 11 determines that the value of M1 is not substantially equal to the initial value, the routine goes to a step S123 since the control unit 11 can estimate that a change in at least one of the response speed of rich to lean and the response speed of rich to lean occurs.

In the step S123, the control unit 11 sets a flag f balance NG to 1 and the routine goes to a step S124. In the step S124, the control unit 11 informs the driver of the failure in the oxygen sensor 14.

In the step S120, the control unit 11 compares a value of M2 indicating the difference between the rich time and lean time in the feedback control mode with the predetermined value corresponding to the initial value of the value of M2 to determine whether the balance between the rich/lean control time is changed with respect to the initial stage thereof. Since, at this time, if the control unit 11 determines that the control time balance is changed at the initial stage, the air/fuel mixture ratio feedback controlled deviates from the initial stoichiometric air/fuel mixture ratio (target air/fuel mixture ratio), the routine goes to steps S123 and S124 in this case in which the setting of the failed flag and information about the failure are carried out.

In a step S121, the control unit 11 carries out the proportional control which can eliminate the rich (lean) state at the first occurrence of the rich (lean) detection and compares the value of M3 indicating the difference in times in both change directions at which the air/fuel mixture ratio is actually started to change in the lean (rich) direction with a predetermined value corresponding to the initial value of the vlaue of M3 so as to determine whether the response balance of the rich/lean detection is changed with respect to the initial value.

If the response balance of the rich/lean detection is changed with respect to the initial stage and the control unit 11 determines that both actual M3 and initial value are substantially equal to each other, the routine goes to steps S123 and S124 in which the setting of the failure indicating flags and display of the failure in the oxygen sensor 14 are carried out.

On the other hand, when the control unit 11 determines that the value of M3 is substantially equal to the initial value in the step S121 and any of the vlaues of M1, M2, and M3 is substantially equal to the initial value so that the change in the resoonse characteristic does not occur, the routine goes to a step S122 in which the flag f balance NG is set to zero to determine that no failure in the response characteristic is recognized.

Figure 14:
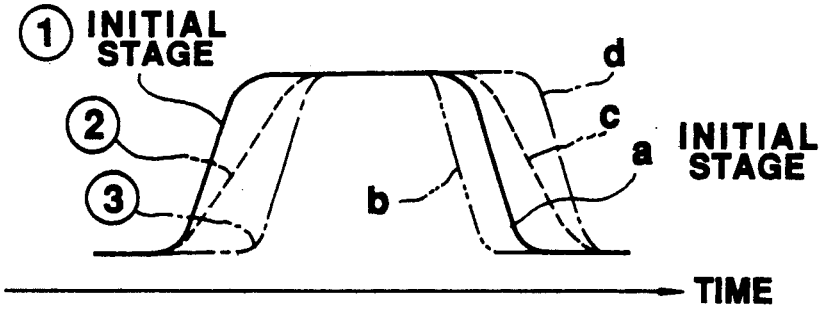
FIG. 14 is a timing chart of a change in the response characteristic due to deterioration in an oxygen sensor.
Figure 15:
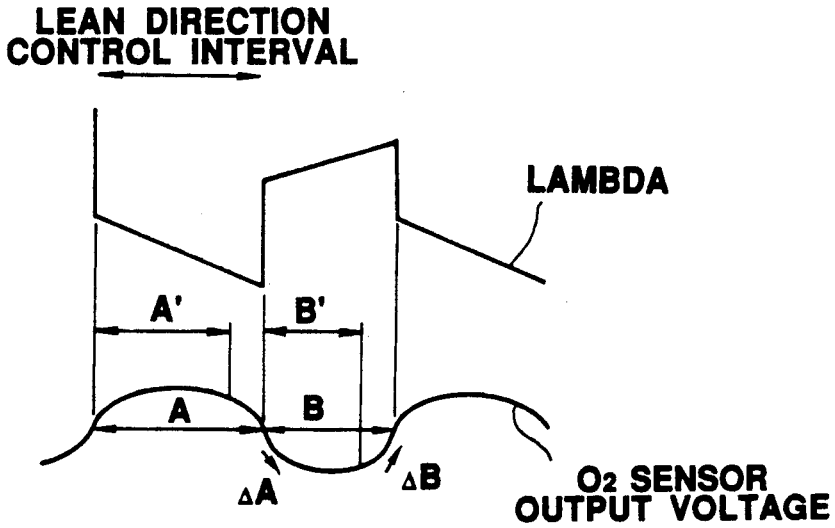
FIG. 15 is a timing chart of a detecting characteristic in the response characteristic in the oxygen sensor.

In this way, in the preferred embodiment, since even if various deterioration patterns in the oxygen sensor 14 as shown in FIG. 14 and Table I are present, the control unit 11 can perform a self diagnosis of the deterioration in the oxygen sensor 14 from the characteristic change particular to each deterioration pattern, the diagnosis of the oxygen sensor 14 can be precisely carried out. For example, since the diagnostic result is displayed to the view of the driver, speedy maintenance is carried out so that driving under which the exhaust characteristic is worsened with the feedback control carried out toward the air/fuel mixture ratio deviated from the target air/fuel mixture ratio can quickly be avoided.

In addition, it is possible to execute the feedback control compensating for the deterioration of the oxygen sensor 14.

Such a deterioration correction (correction control of an operating variable of the air/fuel mixture ratio feedback correction coefficient LAMBDA) described below with reference to a flowchart of FIG. 5.

Figure 5:
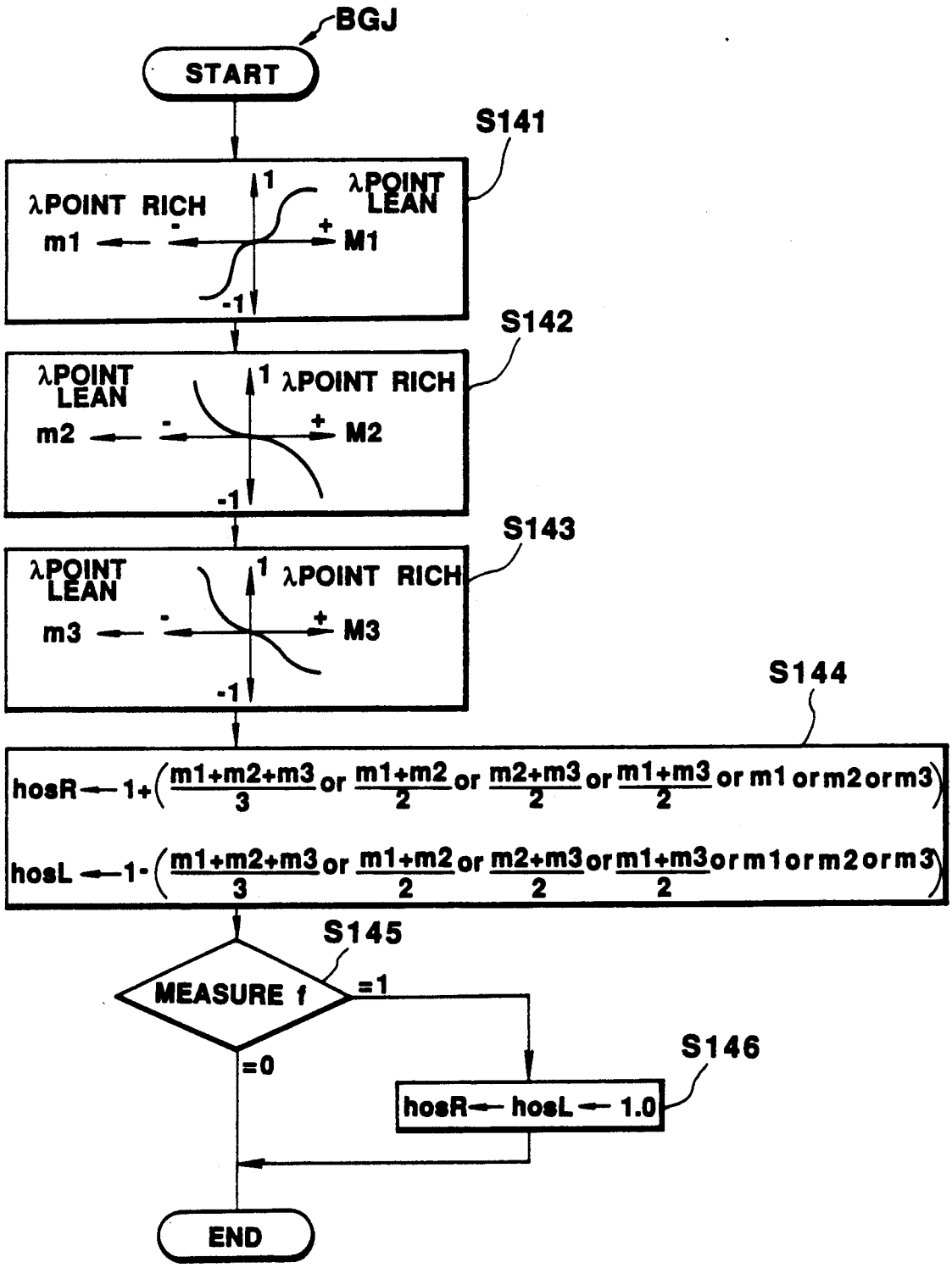
FIG. 5 is a program flowchart executed by the air/fuel mixture ratio controlling system shown in FIG. 1.

FIG. 5 shows a program flowchart executed in background processing.

In steps S141, S142, and S143, the control unit 11 sets respective membership values m1, m2, and m3 indicating respective deviation values for the initial values M1, M2, and M3 indicaitng the balances between the rich time and lean time in the feedback control on the basis of previously set membership functions used for fuzzy control.

It is noted that the membership functions shown in the flowchart of FIG. 5 are a case where the initial values are zero but may be applied to the case where the initial values do not indicate zero.

Correction coefficients hosL and hosR to correct the proportional coefficients PL and PR (operating variables) are used when the air/fuel mixture ratio feedback correction coefficient LAMBDA is proportionally controlled on the basis of the membership values m1, m2, and m3 in a step S144.

The correction coefficients hosL and hosR are derived by correcting a reference value 1, e.g., with average values of the respective membership values m1, m2, and m3, with the average values among two of the membership values, or solely with the respective membership values m1, m2, and m3.

Figure 16:
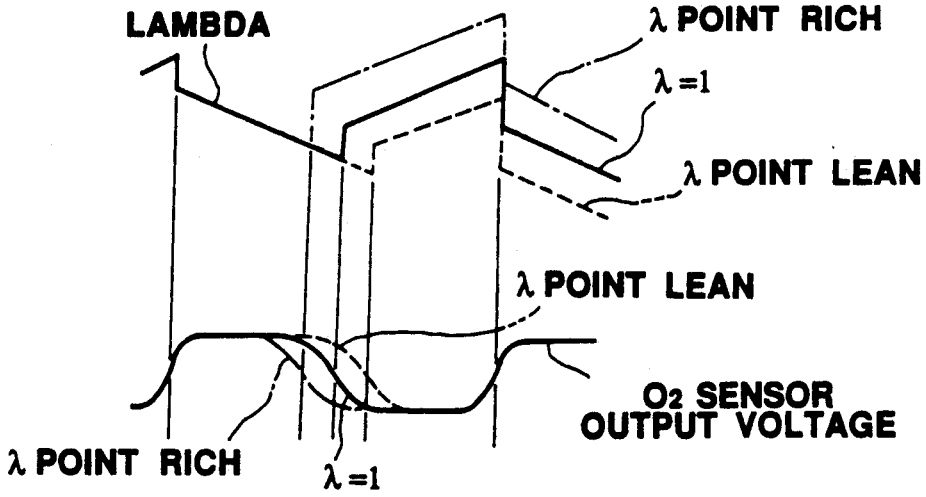
FIG. 16 is a timing chart representing a change in the air/fuel mixture control point due to the change in the response balance of the oxygen sensor.

In a case where the controlled air/fuel mixture ratio tends to deviate on the lean side, as denoted by dotted lines of FIG. 16, (in other words, the response of the oxygen sensor 14 is delayed when the air/fuel mixture ratio is controlled in the lean direction with respect to the case in the lean direction) each membership value m1, m2, and m3 is set on the plus side. When the controlled air/fuel mixture ratio tends to deviate in the lean direction, the incremental correction of the air/fuel mixture ratio feedback correction coefficient LAMBDA is made larger by means of the proportional control at the time of the first occurrence of lean detection. On the contrary, it is necessary that the decremental correctin of the correction coefficient LAMBDA by means of the proportional control at the first occurrence of rich detection is made smaller.

Therefore, the correction coefficient hosL to correct the proportional control coefficient PL at the first occurrence of the rich detection is made smaller as the tendency to become a lean air/fuel mixture ratio becomes great.

The correction coefficient hosL is incrementally set as each membership value m1, m2, and m3 is increased. The correction coefficient hosR is decrementally set as each membership value m1, m2, and m3 is increased. The former is set in the form adding a value to the reference value 1 and the latter is set in the form subtracting the value from the reference value 1.

The correction coefficients hosL and hosR are multiplied by the proportional coefficients PR, PL searched and found from the map on the basis of the basic fuel injection quantity $T_p$ and engine revolutional speed N in the proportional control at the first occurrence of rich and lean detections in the proportional/intergal control of the air/fuel mixture ratio feedback correction coefficient LAMBDA shown in the flowchart of FIG. 2.

The deviation of air/fuel mixture ratio fedback on the basis of the change in the response balance due to the deterioration in the oxygen sensor 14 is compensated for by the correction in the proportional/integral control coefficients.

In the step S145, the determination of the flag f measurement is carried out. During the deterioration diagnosis in which the control unit 11 determines that the flag f measurement indicates 1, the routine goes to the step S146 in which the control unit 11 resets the correction coefficients hosR and hosL to the reference values 1, respectively.

Figure 7:
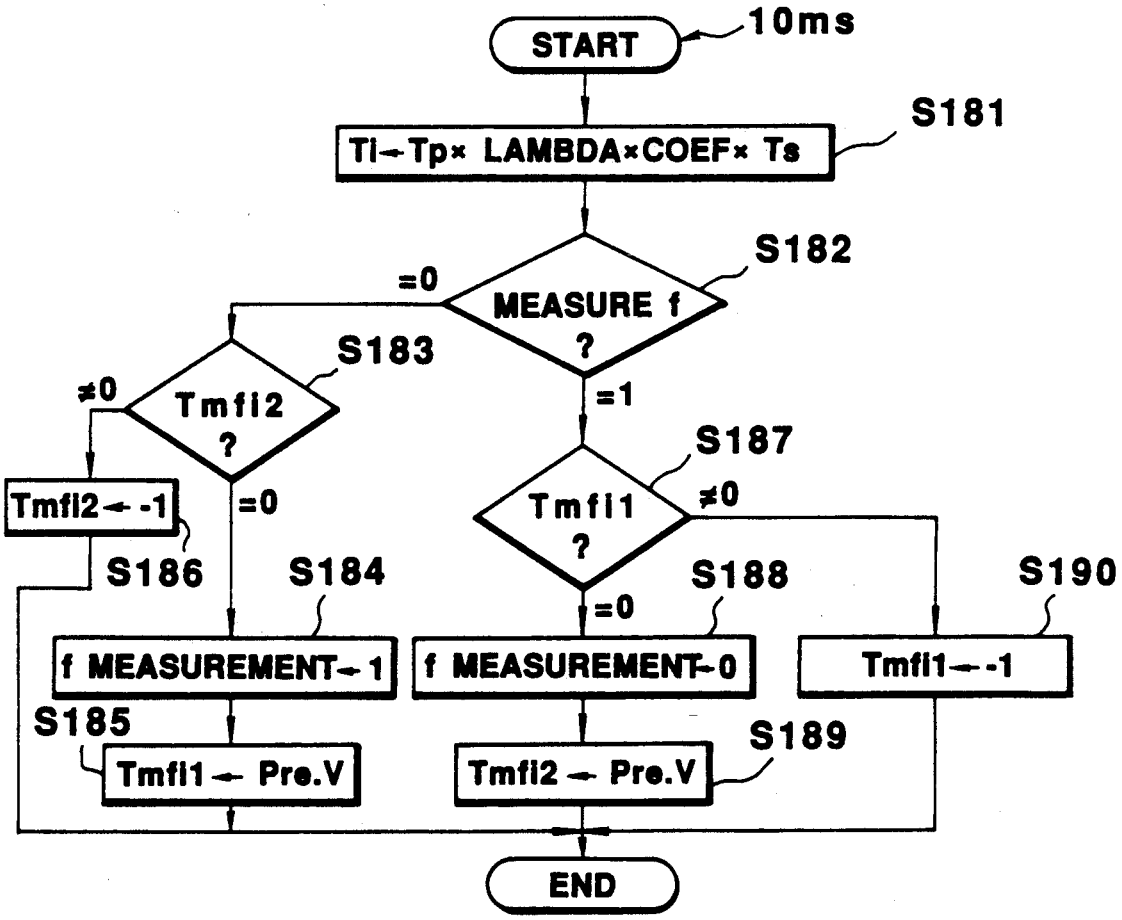
FIG. 7 is a program flowchart executed by the air/fuel mixture ratio controlling system shown in FIG. 1.
Figure 8:
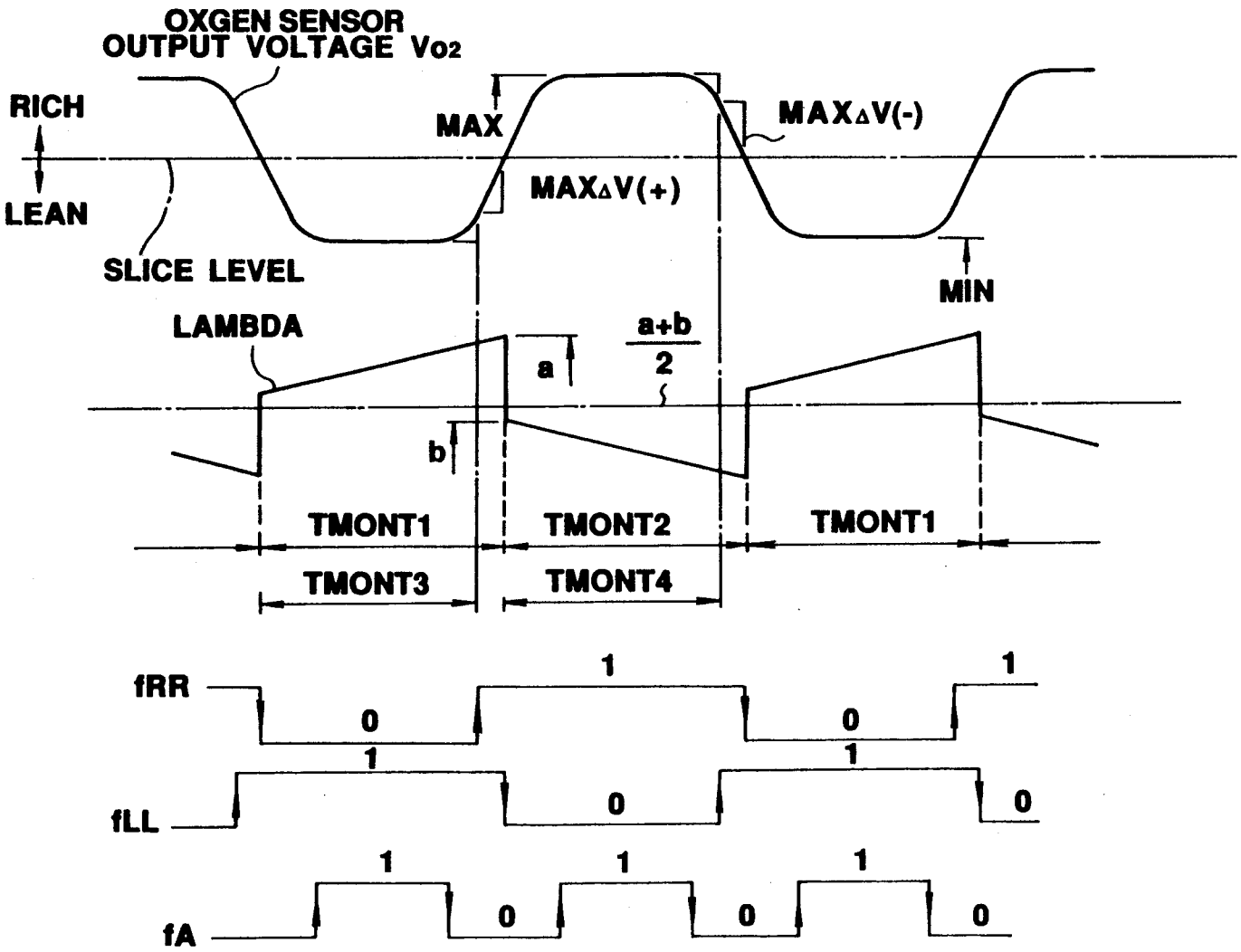
FIG. 8 is a timing chart of a control characteristic in the preferred embodiment.
Figure 9:
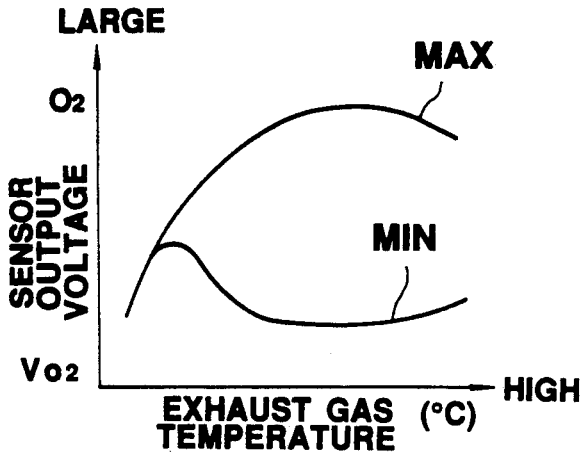
FIG. 9 is an output characteristic representing a relationship between an output voltage and exhaust gas temperature.
Figure 10:
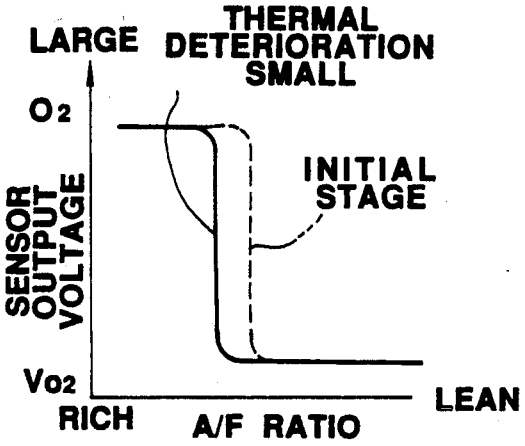
FIG. 10 is an output characteristic representing a relationship between an output voltage of an oxygen sensor used in the system shown in FIG. 1 and an air/fuel mixture ratio.
Figure 11:
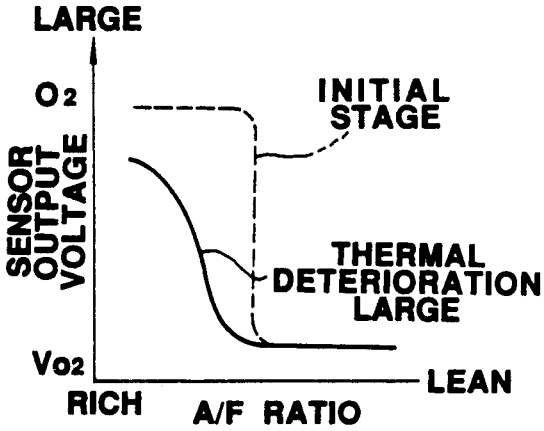
FIG. 11 is an output characteristic representing a relationship between an output voltage of an oxygen sensor used in the system shown in FIG. 1 and an air/fuel mixture ratio.
Figure 12:
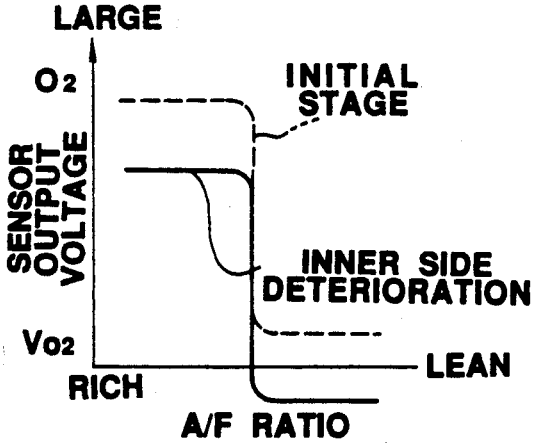
FIG. 12 is an output characteristic representing a relationship between an output voltage of an oxygen sensor used in the system shown in FIG. 1 and an air/fuel mixture ratio.
Figure 13:
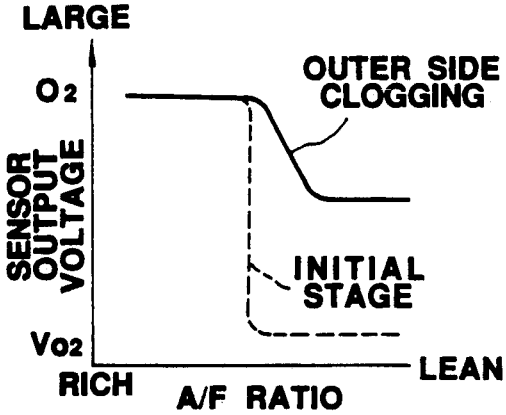
FIG. 13 is an output characteristic representing a relationship between an output voltage of an oxygen sensor used in the system shown in FIG. 1 and an air/fuel mixture ratio.

The air/fuel mixture ratio feedback correction coefficient LAMBDA set when the proportional/intergal control is carried out in the program shown in the flowchart of FIG. 2 is used to calculate a final fuel injection quanitity $T_i$, as shown in FIG. 7.

The program shown in the flowchart of FIG. 7 is executed for each predetermined period of time (10 milliseconds).

In a step S181, the fuel injection quantity $T_i$ is calculated, e.g., in the following equation:

$$T_i \leftarrow T_p \times \text{LAMBDA} \times \text{COEF} + \text{Ts}$$

In the above equation, COEF denotes various correction coefficients set on the basis of the coolant temperature Tw detected by the coolant temperature sensor 12 and Ts denotes a correction coefficient used to correct the change in an effective opening duration due to a voltage change of the vehicular battery which is a drive power supply for the fuel injection valve 10.

The fuel injection quantity Ti finally set is set in an output registor. When it becomes a predetermined injection time, the latest fuel injection quantity Ti is read out of the output register so that a drive pulse signal having a pulsewidth corresponding to the fuel injection quantity Ti is outputted to the fuel injection valve 10 so as to control intermittent fuel injection through the fuel injection valve 10.

In the next step S182, the control unit 11 determines the flag f measurement used for the switching control of the diagnosis, the flag f measurement determining whether the deterioration diagnosis of the oxygen sensor 14 should be carried out. When the flag f measurement is determined to be zero, the routine goes to a step S183 in which the control unit 11 determines whether a timer Tmfi2 measuring the time during which the oxygen sensor is not diagnosed is zero. If zero, the routine goes to a step S184 in which the flag f measurement is set to 1 and sets a timer Tmfil measuring the time during which the diagnosis is carried out to a predetermined value. If, in the step S183, the control unit 11 determines that the timer value Tmfi2 is not zero, the routine goes to a step S186 in which one is decremented from the timer value Tmfi2.

In a case where the flag f measurement is set to 1 and a predetermined value is set to the timer Tmfil, during the next program run, the control unit 11 determines that the flag f measurement indicates 1 in the step S182 and the routine goes to the step S187 in which the control unit 11 determines whether the timer Tmfil indicates zero. If, in the step S187, the control unit 11 determines that the timer Tmfil is not zero, the routine goes to a step S190 in which one is decremented from the timer value Tmfil. Hence, since 1 remains set as the flag f measurement until the timer Tmfil is changed from the predetermined value to zero due to the processing in the step S190. During this time, the oxygen sensor 14 receives the deterioration diagnosis.

If the timer Tmfil indicates zero, the control unit 11, in turn, sets the flag f measurement to zero in a step S188 and a predetermined value is set to the timer Tmfi2. The deterioration diagnosis is cancelled until the timer value Tmfi2 becomes zero in the processing of the step S186 and carries out the normal air/fuel mixture ratio control routine.

It is noted that the meaning of the symbols used in the program flowcharts shown in FIG. 2 (A) to FIG. 7 will be described below for reference purposes.

LAMBDA: air fuel mixture ratio correction coefficient.

Tmont: the timer measuring a lapse time from the time at which the air/fuel mixture ratio is reversed.

fR: the flag indicating whether the rich air/fuel mixture ratio detection occurs first.

fL: the flag indicating whether the lean air/fuel mixture ratio detection occurs first.

TMONT1: lean detection duration of time (a time for the rich control to be carried out for LAMBDA)

Tmonte2: rich detection duration of time (a time for the lean control to be carried out for LAMBDA)

TMONT3: the time it takes for the air/fuel mixture ratio to start to change in the rich direction upon the first occurrence of the lean detection.

TMONT4: the time it takes for the air/fuel mixture ratio to start to change in the lean direction upon the first occurrence of the rich detection.

PL: the operating variable of the lean control in the LAMBDA.

PR: the operating variable of the rich control in the LAMBDA.

hosL: the correction coefficient for the lean control:

hosR: the correction coefficient for the rich control:

fLL: the flag indicating whether the output voltage of the oxygen sensor 14 is first detected that it is decreased at a rate exceeding the predetermined value.

fRR: the flag indicating whether the output voltage of the oxygen sensor 14 is first detected that it is increased at a rate exceeding the predetermined value. It is reset to zero upon the first occurrence of the lean detection.

regb: the register storing LAMBDA−PL regc: the register storing $\Delta V_{o2}$ fA: the flag indicating whether the output voltage $V_{o2}$ is substantially constant (0) or changing (1).

Tmacc: a timer indicating that the engine operation condition falls in a steady state condition.

$\lambda_{conon}$: the flag indicating whether the intial condition of the engine is met.

f measurement: the flag used to control the switching to carry out the deterioration diagnosis for the oxygen sensor.

$f_{MAXMIN}$: the flag which is set to 1 when the engine has entered the predetermined high exhaust temperature region and is reset to zero when the ignition switch is turned on.

$fV_{o2}NG$: the flag indicating whether the output voltage level of the oxygen sensor 14 is abnormal.

f period NG: the flag indicating whether the control period of the air/fuel mixture ratio control is abnormal.

f balance NG: the flag indicating whether the change in the response characteristic of the oxygen sensor is abnormal.

M1: the register storing the difference in the change speeds when the output of the oxygen sensor 14 is changed to the increase direction and to the decrease direction.

M2: the register storing the difference between the lean detection duration and the rich detection duration.

M3: the register storing the difference in both change directions of times for the actual air/fuel mixture ratio to start to change in the rich (lean) direction after the proportional control is carried out which can eliminate the rich (lean) state upon the first occurrence of the rich (lean) detection.

Tmfi1: the timer to measure the time during which the deterioration diagnosis is carried out.

Tmfi2: the timer to measure the time during which the deterioration diagnosis is not carried out.

It is also noted that although, in the preferred embodiment, the basic fuel injection quantity $T_p$ is calculated on the basis of the intake air quantity Q detected by means of the air flow meter, a pressure sensor for detecting intake air pressure may alternatively be provided to calculate the basic fuel injection quantity $T_p$ on the basis of the detected pressure PB. Alternatively, the basic fuel injection quantity $T_p$ may be calculated on the basis of the opening angle area in the intake air system and engine revolutional speed. In addition, the oxygen sensor 14 may have a layer for reducing and catalyzing nitro oxide $NO_x$ as disclosed in a Japanese Patent Application First Publication No. Showa 64-458 published on Jan. 5, 1989, the disclosure of which is hereby incorporated by reference.

As described hereinabove, since in the system and method for correcting the air/fuel mixture ratio feedback correction coefficient in which the an air/fuel mixture ratio of air mixture fuel sucked into the engine is detected on the basis of concentration of the exhaust gas component and the fuel supply quantity is feedback controlled so as to make the detected air/fuel mixture ratio approach the target air/fuel mixture ratio according to the present invention, the response balance between the rich side and lean side in the air/fuel mixture ratio detecting means is detected and operating variable of the air/fuel mixture ratio feedback correction value is corrected on the basis of the response balance. Therefore, even if the air/fuel mixture ratio feedback controlled deviates from the target air/fuel mixture ratio due to the deterioration of the oxygen sensor (air/fuel mixture ratio detecting means), it is possible to derive the target air/fuel mixture ratio by correcting the air/fuel mixture ratio. Consequently, the exhaust gas characteristic of the engine can be maintained at that initial stage.

It will fully be appreciated by those skilled in the art that the foregoing description has been made in terms of the preferred embodiment and various changes and modifications may be made in terms of the preferred embodiment without departing from the scope of the present invention which is to be defined by the appended claims.

What is claimed is:

1. A system for an internal combustion engine, comprising:

a) a first means for detecting a concentration of an engine exhaust gas component so as to determine whether an air/fuel mixture ratio of an air/fuel mixture sucked into the engine is placed at a rich side or lean side with respect to a stoichiometric air/fuel mixture ratio;

b) second means for setting an air/fuel mixture ratio feedback correction coefficient to correct a quantity of fuel supplied to the engine on a feedback basis in response to the air/fuel mixture ratio detected by the first means so that the air/fuel mixture ratio approaches the stoichiometric air/fuel mixture ratio;

c) third means for controlling the quantity of fuel supplied to the engine on the basis of the quantity of fuel corrected with the air/fuel mixture ratio correction coefficient set by the second means; and d) fourth means for detecting a degree of deterioration of the first means from an output characteristic of the first means and correcting an operating variable of the feedback correction coefficient set by the second means according to the degree of deterioration detected so as to compensate for deviation of the air/fuel mixture ratio of the air/fuel mixture detected by the first means from the stoichiometric air/fuel mixture ratio.

2. A system as set forth in claim 1, wherein the fourth means includes fifth means for detecting a response balance between response of an output derived from the first means to a rich side control of the air/fuel mixture ratio and response to a lean side control when the quantity of fuel is feedback corrected with the air/fuel mixture ratio feedback correction coefficient se by the second means, an operating variable of the air/fuel mixture ratio during the rich side control being the same as that during the lean side control, the response balance being detected on the basis of at least one of a plurality of parameters, a first parameter being a speed of change of the output of the first means in each of the rich and lean directions, a second parameter being a duration from a time at which the air/fuel mixture ratio is reversed to each of the rich side and lean side with respect to the stoichiometric air/fuel mixture ratio to a time at which teh detected air/fuel mixture ratio is started to change toward the stoichiometric air/fuel mixture ratio, and a third parameter being a duration during which each of the rich side and lean side control is carried out and sixth means for correcting the operating variable of the air/fuel mixture ratio feedback correction coefficient set by the second means on the basis of the response balance detected by the fifth means.

3. A system as set forth in claim 2, wherein the fourth means corrects the operating variable of the air/fuel mixture ratio correction coefficient according to the detected response balance indicating the degree of deterioration of the first means so as to compensate for the deviation of an average air/fuel mixture ratio from the correct stoichimetric air/fuel mixture ratio.

4. A system as set forth in claim 3, wherein the operating variable of the air/fuel mixture ratio correction coefficient (LAMBDA) includes a rich proportional coefficient (PR) during rich control for LAMBDA, a lean proportional coefficient (PL) during lean control for LAMBDA, and an integration coefficient (I).

5. A system as set forth in claim 4, wherein the second means comprises:

a) seventh means for detecting an engine operating condition and engine load;

b) eighth means for determining whether the engine operating condition falls in a steady state operating condition;

c) ninth means for determining whether the engine has entered a predetermined high exhaust temperature region;

d) tenth means for setting the rich proportional coefficient (PR) and lean proportional coefficient (PL) with a same predetermined value when the eighth means and ninth means determine that the engine operating condition falls in the steady state operating condition and predetermined high exhaust temperature range and setting the integration coefficient (I) according to the engine load; and e) eleventh means for calculating the air/fuel mixture ratio feedback correction coefficient (LAMBDA) on the basis of the set rich and lean proportional coefficients (PL, PR) and integration coefficient.

6. A system as set forth in claim 5, wherein the seventh means detects an engine coolant temperature ($T_w$), engine revolutional speed (N), intake air quantity (Q), and an opening angle of an engine throttle valve (TVO), and output voltage ($V_{o2}$) of the first means and the seventh means further derives an engine load represented by a basic fuel injection quantity ($T_p$) on the basis of the detected intake quantity (Q) and engine revolutional speed (N).

7. A system as set forth in claim 6, wherein the eighth means determines whether the engine operating condition falls in the steady state operating condition depending on whether the opening angle of the throttle valve (TVO) is substantially constant and a predetermined time (Tmacc) has elasped after the change in the opening angle of the throttle valve.

8. A system as set forth in claim 7, wherein the ninth means determines whether the engine has entered the predetermined high exhaust temperature region depending on whether a value of the basic fuel injection quantity determined from the engine revolutional speed (N) at a boundary line of the predetermined high exhaust temperature region is below the actually derived basic fuel injection quantity ($T_p$).

9. A system as set forth in claim 8, wherein the tenth means sets the rich proportional coefficient (PR), the lean proportional coefficient (PL), and integration constant (I) on the basis of the engine revolutional speed and the basic fuel injection quantity ($T_p$) with both proportional coefficients (PL, PR) set with the same predetermined values when the engine has entered the high exhaust temperature region.

10. A system as set forth in claim 9, wherein the second means further includes twelfth means for determining whether the engine coolant temperature exceeds a predetermined temperature and the higher output voltage of the first means at the rich side is above a predetermined high voltage and the lower output voltage of the first means is below a predetermined low voltage, thirteenth means for comparing a maximum value of the output voltage with a value of MAX which is a substantially center value of an output range over which the first means outputs the output voltage when a vehicular ignition switch is turned on and updating the values of the MAX and MIN when the output voltage is above the values of MAX and MIN, respectively, when the twelfth means determines that the engine coolant temperature exceeds the predetermined temperature and the higher output voltage of the first means is above the predetermined high voltage and the lower output voltage is below the predetermined low voltage, and fourteenth means for determining whether the output voltage of the first means is the center value of the output range which corresponds to a slice level of the stoichiometric air/fuel mixture ratio.

11. A system as set forth in claim 10, wherein the second means further includes fifteenth means for setting the maximum value of LAMBDA upon a first occurrence of the rich state, measuring a first duration of time (TMONTI) during which the rich control of LAMBDA is carried out upon the first occurrence of the lean detection and sixteenth means for setting LAMBDA as $(a+b)/2-\alpha$ ($\alpha$ denotes a fixed value and b denotes a minimum value of LAMBDA upon the first occurrence of lean detection) when the engine has once entered the predetermined high exhaust temperature region.

12. A system as set forth in claim 11, wherein the sixteenth means sets the air/fuel mixture ratio feedback correction coefficient (LAMBDA) as LAMBDA−PL×hosL, wherein hosL denotes a lean control correction coefficient set according to a deviation of the average air/fuel mixture ratio from the correct stoichiometric air/fuel mixture ratio, when the engine has not entered the predetermined high exhaust temperature region.

13. A system as set forth in claim 12, wherein the second means further includes seventeenth means for setting the minimum value of the air/fuel mixture ratio feedback correction coefficient (LAMBDA) as b upon the first occurrence of lean state detection, measuring a second duration of time (TMONT2) during which the lean control is carried out upon the first occurrene of the rich state detection, and eighteenth means for setting the air/fuel mixture ratio feedback correction coefficient (LAMBDA) as $(a+b)/2+\alpha$ when the engine has entered the predetermined high exhaust temperature region.

14. A system as set forth in claim 13, wherein the eighteenth means sets the air/fuel mixture feedback correction coefficient (LAMBDA) as LAMBDA+PR×hosR (wherein hosR denotes the correction coefficient for the rich proportional correction coefficient (PR) which corresponds to the deviation of the average air/fuel mixture ratio from the stoichimetric air/fuel mixture ratio).

15. A system as set forth in claim 14, wherein the sixteenth and seventeenth means set the air/fuel mixture ratio feedback correction coefficient (LAMBDA) with the integration coefficient (I) determined according to the engine revolutional speed (N) and basic fuel injection quantity ($T_p$) upon a second and subsequent occurrences of the rich and lean detections.

16. A system as set forth in claim 15, wherein the second means further includes; ninteenth means for calculating a change rate of the output voltage of the first means per unit of time; twentieth means for measuring a third duration of time (TMONT3) for which the air/fuel mixture ratio is started to change toward the rich state direction upon the first occurrence of the lean detection according to the calculated change rate of the output voltage of the first means; and twenty-first means for measuring a fourth duration of time (TMONT4) for which the air/fuel mixture ratio is changed toward the lean state direction upon the first occurrence of the rich detection according to the calculated change rate of the output voltage of the first means.

17. A system as set forth in claim 16, wherein the fourth means comprises: twentysecond means for deriving a first value (M1) from maximum change rates of the output voltage of the first means at the rich and lean sides (MAXΔ V(+), MAXΔ V(−)), a second value (M2) from a difference between the first duration of time (TMONT1) and second duration of time (TMONT2), and a third value (M3) from a difference between the third duration of time (TMONT3) and the fourth duration of time (TMONT4); twentythird means for setting membership values (m1, m2, and m3) indicating degrees of deviations of the first, second, and third values (M1, M2, and M3) from their initial values on the basis of membership functions, respectively, and setting the correction coefficients (hosR, hosL) to correct the rich and lean proportional control coefficients (PR, PL) according to at least one of an average value of the membership values (m1, m2, and m3), an average value of two of the memebership values (m1, m2, and m3), and solely one of the membership values (m1, m2, and m3).

18. A system as set forth in claim 17, wherein the correction coefficients hosR and hosL are expressed respectively as follows:

hosR: $1+(m1+m2+m3)/3$, $(m1+m2)/2$, $(m2+m3)/2$, $(m1+m3)/2$, m1, m2, or m3;

hos L: $1-(m1+m2+m3)/3$, $(m1+m2)/2$, $(m2+m3)/2$, $(m1+m3)/2$, m1, m2, or m3.

19. A system as set forth in claim 17, wherein the twentythird means sets the correction coefficients hosR and hosL to 1.0 when the engine has entered the predetermined high exhaust temperature region.

20. A system as set forth in claim 19, wherein the first means includes a oxygen sensor installed in an exhaust passage of the engine.

21. A system as set forth in claim 20, wherein the center value of the output range over which the oxygen sensor outputs the voltage is substantially 500 millivolts.

22. A system as set forth in claim 21, wherein the predetermined high voltage is substantially 720 millivolts and the predetermined low voltage is substantially 230 millivolts.

23. A system for diagnosing an oxgen sensor used for a system for controlling an air/fuel mixture ratio of an air/fuel mixture sucked in an internal combustion engine, comprising:

a) first means for detecting an engine operating condition and determining whether the engine has entered a predetermined high exhaust temperature region;

b) second means for determining whether the engine is operating in a steady state condition;

c) third means for detecting a maximum and minimum values of an output voltage of the oxygen sensor and determing whether the detected maximum and mimimum values are substantially equal to respective first predetermined values when the first means determines that the engine has entered the predetermined high exhaust temperature region and the second means determines that the engine is operating in the steady state condition; and d) fourth means for indicating that the oxygen sensor has failed when the third means determines that either or both of the maximum and minimum values are not substantially equal to the respective first predetermined values.

24. A system as set forth in claim 23, which further includes:

fifth means for detecting an engine operating condition;

sixth means for searching an initial value of a control period of air/fuel mixture ratio feedback control on the basis of the detected engine operating condition;

seventh means for deriving the control period from a first duration of time during which the oxygen sensor detects a lean state of the air/fuel mixture ratio (TMONT1) and a second duration of time during which the oxygen sensor detects a rich state of the air/fuel mixture ratio (TMONT2); and eighth means for determining whether the control period derived by the seventh means is longer than an initial value and wherein the fourth means indicates that the oxygen sensor has failed when the eighth means determines that the control period is longer than the initial value.

25. A system as set forth in claim 24, which further includes:

ninth means for determining whether the output voltage of the oxygen sensor is substantially constant;

tenth means for adding a maximum value MAX V(+) of a change rate ($Vo_2$) of the output voltage at a plus side to a maximum value MAX V(−) at a minus side and determining whether the added value ($M_1$) is substantially equal to a second predetermined value;

eleventh means for subtracting the value of TMONT2 from the value of TMONT1 and determining whether the subtracted value ($M_2$) is substantially equal to a third predetermined value;

twelfth means for subtracting a third duration of time (TMONT3) during which the air/fuel mixture ratio is changed in the lean state direction upon a first occurrence of the rich state detection of the oxygen sensor from a fourth duration of time (TMONT4) during which the air/fuel mixture ratio is changed in the rich state direction upon a first occurrence of the lean state detection and determining whether the subtracted value ($M_3$) is substantially equal to a fourth predetermined value, and wherein the fourth means indicates that the oxygen sensor has failed when the tenth, eleventh, and twelfth means determine that each corresponding value ($M_1$, $M_2$, $M_3$) is not substantially equal to the corresponding second, third, and fourth predetermined value and the voltage of the oxygen sensor is substantially constant;

tenth means for adding a maximum value MAX V(+) of a change rate ($Vo_2$) of the output voltage at a plus side to that MAX V(−) at a minus side and determining whether the added value ($M_1$) is substantially equal to a second predetermined value;

eleventh means for subtracting the value of TMONT1 and determining whether the subtracted value ($M_2$) is substantially equal to a third predetermined value;

twelfth means for subtracting a third duration of time (TMONT4) during which the air/fuel mixture ratio is changed in the lean state direction upon a first occurrence of the rich state detection by the oxygen sensor from the fourth duration of time (TMONT4) during which the air/fuel mixture ratio is changed in the rich state direction upon a first occurrence of the lean state detection by the oxygen sensor and determining whether the subtracted value (M3) is substantially equal to a fourth predetermined value, and wherein the fourth means indicates that the oxygen sensor has failed when the tenth, eleventh, and twelfth means determine that each corresponding value ($M_1$, $M_2$, and $M_3$) is not substantially equal to the corresponding second, third, and fourth predetermined values.

26. A system as set forth in claim 25, wherein the second, third, and fourth predetermined values correspond to their initial values.

27. A method for controlling an air/fuel mixture ratio of an air/fuel mixture supplied to an internal combustion engine, comprising the steps of:

a) providing first means for detecting a concentration of an engine exhaust gas component so as to determine whether an air/fuel mixture ratio of an air/fuel mixture sucked into the engine is placed at a rich side or lean side with respect to a stoichiometric air/fuel mixture ratio;

b) setting an air/fuel mixture ratio feedback correction coefficient to correct a quantity of fuel supplied to the engine on a feedback basis in response to the air/fuel mixture ratio detected in the step a) so that the air/fuel mixture ratio approaches the stoichiometric air/fuel mixture ratio;

c) controlling a quantity of fuel supplied to the engine on the basis of the quantity of fuel corrected with the air/fuel mixture ratio correction coefficient set in the step b); and d) detecting a degree of deterioration of the first means from an output characteristic of the first means and correcting an operating variable of the feedback correction coefficient set according to the detected degree of deterioration so as to compensate for a deviation of the air/fuel mixture ratio of the air/fuel mixture detected by the first means from the correct stoichiometric air/fuel mixture ratio.

28. A method as set forth in claim 27, wherein the fourth step d) includes a step e) of detecting a response balance between the response of the output derived from the first means to a rich side control of the air/fuel mixture ratio and the response of the output to a lean side control when the quantity of fuel is feedback corrected with the air/fuel mixture ratio feedback correction coefficient set in the second step b), the operating variable of the air/fuel mixture ratio during the rich side control being the same as during the lean side control, the response balance being detected on the basis of at least one of a plurality of parameters, a first parameter being a speed of change of the output of the first means in each of the rich and lean directions, a second parameter being a duration from a time at which the air/fuel mixture ratio is reversed to each of the rich side and lean side with respect to the stoichiometric air/fuel mixture ratio to a time at which the detected air/fuel mixture ratio is started to change toward the stoichiometric air/fuel mixture ratio, and a third parameter being a duration during which each of the rich side and lean side control is carried out and a sixth parameter for correcting the operating variable of the air/fuel mixture ratio feedback correction coefficient set in the second step b) on the basis of the detected response balance.

* * * * *